US007282861B2

(12) United States Patent
Hirohashi et al.

(10) Patent No.: US 7,282,861 B2
(45) Date of Patent: Oct. 16, 2007

(54) LIGHT SOURCE DEVICE, LIGHTING DEVICE AND LIQUID CRYSTAL DISPLAY DEVICE

(75) Inventors: Masaki Hirohashi, Kyoto (JP); Nobuhiro Shimizu, Nara (JP); Norikazu Yamamoto, Yawata (JP); Teruaki Shigeta, Neyagawa (JP); Yoko Matsubayashi, Ikoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/362,033

(22) Filed: Feb. 27, 2006

(65) Prior Publication Data

US 2006/0139934 A1 Jun. 29, 2006

Related U.S. Application Data

(63) Continuation of application No. PCT/JP04/12283, filed on Aug. 26, 2004.

(30) Foreign Application Priority Data

Aug. 29, 2003 (JP) ..... 2003-306619

(51) Int. Cl.
*H01J 61/00* (2006.01)
*H01J 65/00* (2006.01)
*H01J 11/00* (2006.01)

(52) U.S. Cl. ..... 313/607; 362/362; 313/567; 313/574; 313/234

(58) Field of Classification Search ..... 313/607, 313/234; 362/362
See application file for complete search history.

(56) References Cited

U.S. PATENT DOCUMENTS

| | | | | |
|---|---|---|---|---|
| 6,194,821 | B1 | 2/2001 | Nakamura | 313/238 |
| 6,331,064 | B1 | 12/2001 | Nishiyama et al. | 313/607 |
| 6,806,647 | B2 * | 10/2004 | Yamamoto et al. | 313/607 |
| 2001/0050735 | A1 | 12/2001 | Yajima et al. | 349/65 |
| 2002/0027774 | A1 | 3/2002 | Nishiyama et al. | 362/29 |
| 2003/0052611 | A1 | 3/2003 | Yamamoto et al. | 313/637 |

FOREIGN PATENT DOCUMENTS

| | | |
|---|---|---|
| JP | 5-29085 | 2/1993 |
| JP | 5-190150 | 7/1993 |
| JP | 8-96768 | 4/1996 |
| JP | 10-64478 | 3/1998 |
| JP | 10-112290 | 4/1998 |
| JP | 11-329365 | 11/1999 |
| JP | 2000-162593 | 6/2000 |
| JP | 2001-126664 | 5/2001 |
| JP | 2001-325919 | 11/2001 |
| JP | 2002-82327 | 3/2002 |
| JP | 2003-178717 | 6/2003 |
| JP | 2003-257377 | 9/2003 |

* cited by examiner

*Primary Examiner*—Sikha Roy
*Assistant Examiner*—Natalie K. Walford
(74) *Attorney, Agent, or Firm*—Wenderoth, Lind & Ponack, L.L.P.

(57) ABSTRACT

A light source device has a bulb, a discharge medium containing rare gas sealed inside the bulb, an internal electrode disposed inside the bulb, and an external electrode disposed outside the bulb. A holder member holds the external electrode so that the external electrode is opposed to the bulb with a predetermined distance of a space therebetween.

15 Claims, 30 Drawing Sheets

LIGHT SOURCE DEVICE, LIGHTING DEVICE AND LIQUID CRYSTAL DISPLAY DEVICE

This is a continuation application of International Application No. PCT/JP2004/012283, filed Aug. 26, 2004.

BACKGROUND OF THE INVENTION

The present invention relates to a light source device comprising a bulb, a discharge medium mainly composed of a rare gas sealed inside the bulb, and an electrode for exciting the discharge medium. The present invention also relates to a lighting device, such as a back light device, comprising this light source device, and a liquid crystal device comprising this back light device.

Recently, research on a light source device that does not use mercury (hereafter referred to as mercury-less type) as a lamp or light source device used for a back light device of a liquid crystal display device is actively progressing, in addition to research on a light source device using mercury for such usage. The mercury-less type light source device is preferable due to low fluctuation of light emission intensity along with time variation of temperature and in view of consideration of environments.

A known mercury-less light source device has a tubular bulb in which a rare gas is sealed, an internal electrode disposed inside the bulb, and an external electrode disposed outside the bulb. Application of a voltage between the internal electrode and external electrode causes a dielectric barrier discharge, resulting in that the rare gas is converted into plasma to emit light.

Various types of external electrodes are known. For example, a conventional light source device shown in FIG. 31A has a bulb 3 in which a rare gas is sealed and a internal electrode 1 is disposed, and a linear external electrode 2 extending parallel to a central axis or an axis line L of the bulb 3 and disposed so as to closely contact an outer surface of the bulb 3. The external electrode 2 is formed by applying metal paste onto the outer surface of the bulb 3, for example. The internal electrode 1 is electrically connected to a lighting circuit 4, and the external electrode 2 is grounded (for example, see Japanese Patent Application Laid-Open Publication No. 5-29085).

An external electrode, in which a conductive element is mechanically pressed to an outer surface of a bulb, is also known. For example, one of conventional light source devices has an external electrode made of a conductive wire member and wound spirally around a bulb so as to closely contact an outer surface of the bulb (for example, see Japanese Patent Application Laid-Open Publication No. 10-112290). Further, another one of conventional light source devices has an external electrode made of a conductive wire member and wound in a coil manner around an outer surface of a bulb, and a shrink tube that secures the external electrode so as to be closely in contact with the outer surface of the bulb (for example, see Japanese Patent Application Laid-Open Publication No. 2001-325919).

Even if the external electrode 2 is formed by coating with metal paste, the external electrode 2 cannot be completely contacted with the outer surface of the bulb 3. In other words, as shown in FIG. 31B, due to various causes, such as manufacturing error, vibration during operation, and a temperature status of an environment, a void or a slight gap 5 is generated between the external electrode 2 and the bulb 3. If the gap 5 exists, electric power cannot be supplied normally to the bulb 3. This causes instability in light emission intensity. Further, a dielectric breakdown of an atmospheric gas tends to occur at the gap 5, and gas molecules ionized by the dielectric breakdown cause damage to peripheral elements or members. For example, if the atmospheric gas is air, the dielectric breakdown generates ozone that causes damage to the peripheral members.

Even if mechanically pressed onto the outer surface of the bulb, this conductive element is detached from the outer surface of the bulb by deflection of the conductive element. Even if such a measure as a shrink tube is used, it is impossible to completely contact the conductive member with the outer surface of the bulb. Therefore, the above-mentioned gap exists between the external electrode and the outer surface of the bulb without exception, thereby causing unstable light emission and dielectric breakdown of the atmospheric gas.

As discussed above, even in a case of an external electrode formed by a chemical method employing metal paste, deposition, sputtering and adhesive, rather than such a physical method as mechanical pressing and use of a shrink tube, a gap between the external electrode and the outer surface of the bulb inevitably exists. The gap causes unstable emission and dielectric breakdown of the atmospheric gas.

SUMMARY OF THE INVENTION

It is an object of the present invention to solve the problems caused by the gap inevitably generated between the external electrode and the outer surface of the bulb, and provide a highly reliable light source device that has a stable light emission characteristic and can reliably prevent dielectric breakdown of atmospheric gas.

A first aspect of the present invention provides a light source device comprising at least one bulb, a discharge medium containing a rare gas and sealed inside the bulb, a first electrode disposed inside the bulb (internal electrode), a second electrode disposed outside the bulb (external electrode), and a holder for holding the second electrode so that the second electrode is opposed to the bulb via a predetermined distance of a space. Specifically, the light source device further comprises a lighting circuit to which the first electrode is electrically connected, and the second electrode is grounded.

The second electrode disposed outside the bulb is opposed to the bulb via the predetermined distance of the space by the holder. In other words, the space is intentionally created between the bulb and the second electrode. Presence of the space achieves stable light emission of the light source device and prevents dielectric breakdown of atmospheric gas, resulting in that a highly reliable light source device can be implemented. Gas molecules of the atmospheric gas ionized by the dielectric breakdown cause damage to peripheral members. For example, if the atmospheric gas is air, dielectric breakdown generates ozone that causes damage to the peripheral members. According to the present invention, by preventing dielectric breakdown of the atmospheric gas, such ionization of the gas molecules of the atmospheric gas can be prevented.

A void is created between the bulb and the second electrode by the holder, so that any shape of bulb can be used. The space between the bulb and the second electrode held by the holder allows any shape of the bulb. Further, since the second electrode does not closely contact the bulb, shape and structure of the second electrode can be simplified. These features achieve a light source device that is inexpensive and easy to manufacture.

To prevent dielectric breakdown of the atmospheric gas with reliability, it is preferable that a distance between the second electrode and the bulb is longer than a shortest distance defined by the following equation.

$$X1L = \frac{V}{E0} - \frac{\varepsilon 1}{\varepsilon 2} \times X2$$

X1L: shortest distance

E0: dielectric breakdown field of atmospheric gas

V: input voltage

∈1: dielectric constant of space

∈2: dielectric constant of a wall of the bulb

X2: thickness of the wall of the bulb.

For example, if gas filled in the space is air (which has a dielectric constant of 1), then it is preferable that the distance between the second electrode and the bulb is set to a range between 0.1 mm and 2.0 mm.

A lower limit of the distance, i.e. 0.1 mm, is obtained based on the above equation. An upper limit of the distance, i.e. 2.0 mm, on the other hand, is determined according to a condition where the light source device can be lit by a reasonable input power. In other words, if the distance is excessively long, the input power for lighting the light source device should also be set excessively high, which is not practical.

An example of the rare gas to be contained in the discharge medium is xenon. Other gases, such as krypton, argon and helium, may be applied. The discharge medium may contain a plurality of types of these rare gases.

The discharge medium may contain mercury in addition to the rare gas.

If the bulb has an elongated shape which extends along an axis line thereof, it is preferable that a cross-section of the second electrode perpendicular to the axis line has a shape surrounding the bulb except for an open section.

It is also preferable that a reflection layer is formed on a surface of the second electrode so as to be opposed to the bulb.

Since the second electrode is disposed via space from the bulb, the electrode is not provided on an outer surface of the bulb. Therefore, the reflection layer formed on the second electrode significantly reduces a ratio of light reflected by the second electrode to return to inside the bulb with respect to light radiated from the bulb. As a result, a total luminous flux of the light radiated from the light source device, i.e. an efficiency of the light source device, can be improved.

Further, it is unnecessary to dispose a separate reflection member to direct light radiated from the bulb to a predetermined direction. In other words, the second electrode also functions as a reflection element. Therefore, structure of the light source device can be simplified.

The reflection layer may be a layer of material with high reflectance formed on a surface of the second electrode, or may be the surface of the second electrode itself with high reflectance.

If the cross-section of the bulb perpendicular to the axis line has a circular shape, it is preferable that a cross-section of the second electrode perpendicular to the axis line of the bulb has a shape except for a concentric circle with respect to the cross-section of the bulb.

For example, the cross-section of the second electrode perpendicular to the axis line of the bulb comprises a pair of first flat walls opposed to each other with the bulb therebetween, and a second flat wall which links the pair of first flat walls and is opposed to an open section with the bulb therebetween. The cross-section of the second electrode may have other shapes, such as an arc, pentagon and triangle.

Alternatively, the bulb has a shape extending along the axis line thereof, and the second electrode has a strip-like shape extending along the axis line of the bulb.

Alternatively, the bulb has a shape extending along the axis line thereof, and plural second electrodes are disposed at intervals along the axis line.

A double tube structure may be applied. In other words, the light source device may further comprise a vessel in which the bulb is enclosed, and the second electrode is formed on an inner face of the vessel. This arrangement allows for gas other than air, such as rare gas, to be filled in the space between the bulb and second electrode.

The light source device may comprise a plurality of bulbs.

In this arrangement, at least one unit of the first electrode is provided for each of the bulbs, and one unit of the second electrode is provided in common for the plurality of bulbs.

A second aspect of the present invention provides a light source device, comprising at least one bulb, a discharge medium containing rare gas and sealed inside the bulb, a first electrode disposed outside the bulb, a second electrode disposed outside the bulb, and a holder for holding the first and second electrodes so that the first and second electrodes are opposed to the bulb via a predetermined distance of space. Specifically, the light source device further comprises a lighting circuit to which the first electrode is electrically connected, with the second electrode being grounded.

A third aspect of the present invention provides a lighting device, comprising the above-mentioned light source device, and a light guide plate for guiding light emitted by the light source device from a light incident surface to a light emitting surface, and emitting the light from the light emitting surface.

A fourth aspect of the present invention provides a liquid crystal display device comprising the above mentioned lighting device, and a liquid crystal panel disposed so as to be opposed to the light emitting surface of the light guide plate.

According to the light source device of the present invention, since the second electrode disposed outside the bulb is opposed to the bulb via a predetermined distance of a space by a holder, light emission is stabilized, and dielectric breakdown of an atmospheric gas can be prevented. Further, the light source device is inexpensive, and can be easily manufactured.

BRIEF DESCRIPTION OF THE DRAWINGS

Other objects and characteristics of the present invention shall be clarified by the following description of preferred embodiments with reference to the accompanying drawings.

DETAILED DESCRIPTION OF THE PREFERRED EMBODIMENTS

Embodiments of the present invention will now be described in detail with reference to the accompanying drawings.

As described with reference to FIGS. 31A and 31B, in spite of that the conventional light source device has the external electrode 2 formed so as to closely contact the outer surface of the bulb 3, the gap 5 is inevitably generated between the external electrode 2 and the bulb 3. Further, the gap 5 causes a dielectric breakdown of atmospheric gas. As described later in detail, the present inventor solved this problem by intentionally providing a space between the external electrode and the bulb. Reasons why the idea of disposing the external electrode away from the bulb could not be acquired from technical common knowledge owned by those skilled in the art will be described hereinbelow.

Figure 31A:
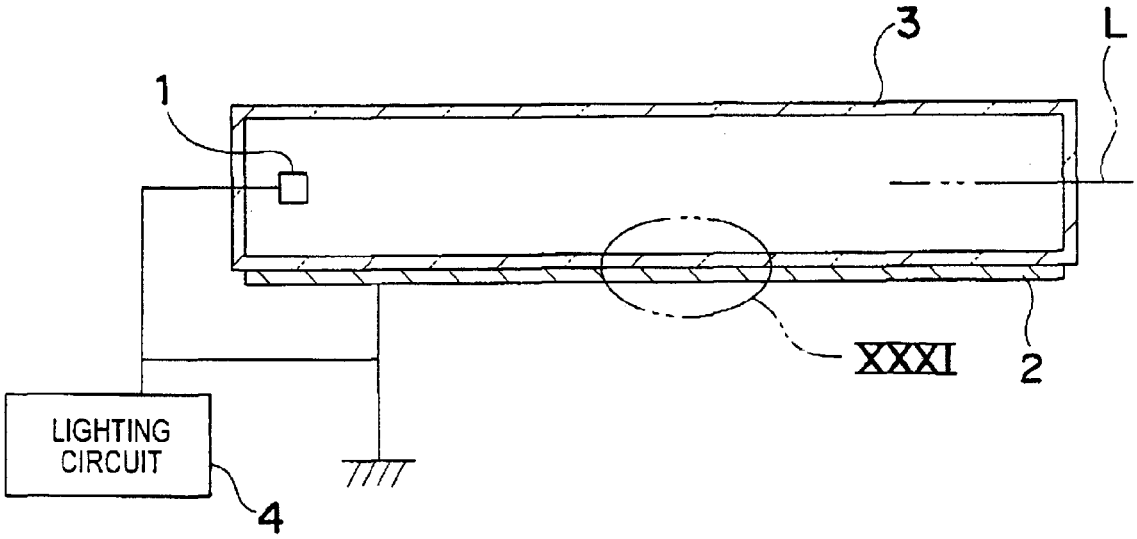
Fig.31A (Prior Art)
FIG. 31A is a cross-sectional view depicting an example of a conventional light source device.
Figure 31B:
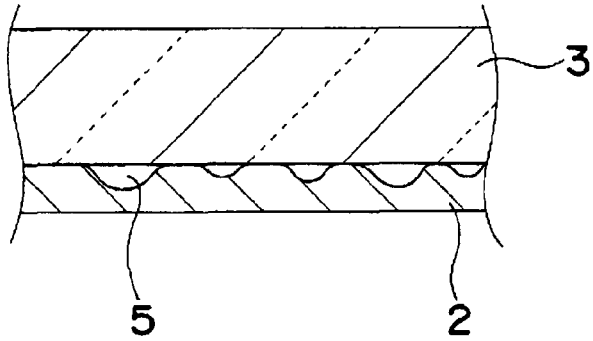
Fig.31B (Prior Art)
FIG. 31B is an enlarged view of a part XXXI in FIG. 31A.
Figure 32A:
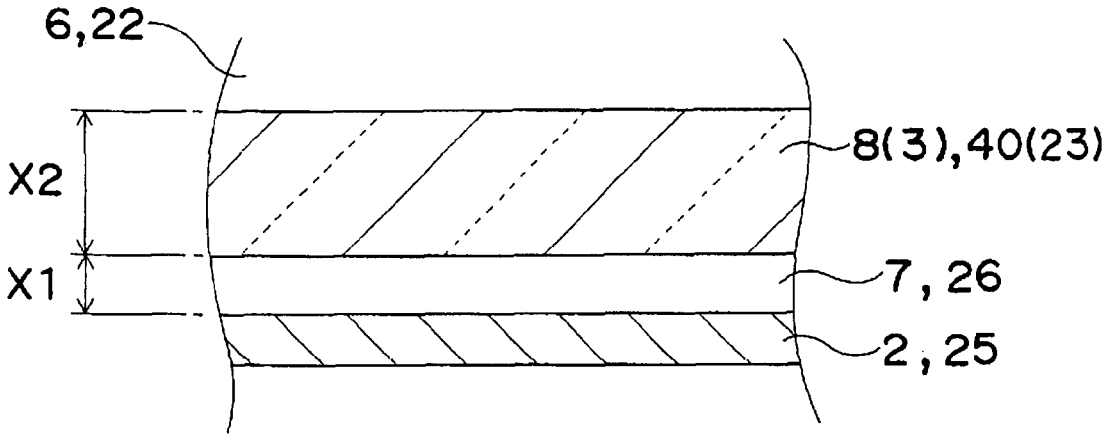
Fig.32A (Prior Art)
FIG. 32A is a partial schematic cross-sectional view depicting the conventional light source device.
Figure 32B:
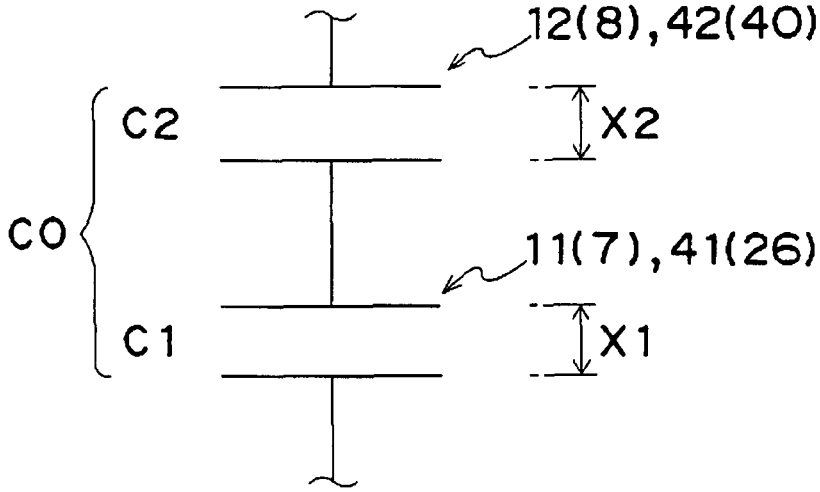
Fig.32B (Prior Art)
FIG. 32B is a diagram depicting an equivalent circuit of FIG. 32A.

FIG. 32A is a partial enlarged cross-sectional view schematically depicting the light source device in FIG. 31A, where gap 7 and a solid dielectric layer 8, including a wall of the bulb, is interposed between external electrode 2 and discharge space 6. As shown in FIG. 32B, the gap 7 and the solid dielectric layer 8 can be regarded as equivalent to capacitors 11 and 12 connected in series.

According to the definition of a capacitor, capacitances C1 and C2 of capacitors 11 and 12 are respectively given by following equation (1).

$$C1 = S \cdot \varepsilon 1 / X1 \qquad (1)$$

$$C2 = S \cdot \varepsilon 2 / X2$$

In equation (1), "S" denotes an area of the external electrode 2 covering bulb 3, "∈1" denotes a dielectric constant of the gap 7, "∈2" denotes a dielectric constant of the solid dielectric layer 8, "X1" denotes a distance of the gap 7, and "X2" denotes a thickness of the solid dielectric layer 8.

Since the capacitors 11 and 12 are connected in series, a combined capacitance C0 is given by following equation (2).

$$\frac{1}{C0} = \frac{1}{C1} + \frac{1}{C2} \tag{2}$$

By applying equation (1) to equation (2), following equation (3) is acquired.

$$C0 = \frac{\varepsilon 1 \cdot \varepsilon 2 \cdot S}{\varepsilon 2 \cdot X1 + \varepsilon 1 \cdot X2} \tag{3}$$

If air is filled in the gap 7, "∈1" equals 1, and following expression (3)' is established.

$$C0 = \frac{\varepsilon 2 \cdot S}{\varepsilon 2 \cdot X1 + X2} \tag{3'}$$

Generally, a relationship indicated by following equation (4) is established among an electric charge Q, a capacitance C and a voltage V.

$$Q = CV \tag{4}$$

If the distance X1 of the gap 7 (layer of air) increases, the combined capacitance C0 decreases, as understood by equation (3)'. If the combined capacitance C0 decreases, the electric charge Q decreases, as understood by equation (4). Decreasing of the electric charge Q means a decrease of the electric charge of the dielectric layer, i.e. the solid dielectric layer 8 and the gap 7. This means that energy to contribute to light emission decreases; in other words, a luminous efficiency is reduced.

As discussed above, the increase of the distance X1 of the gap 7 results in reduction of luminous efficiency. Therefore, for those skilled in the art, the idea of increasing the distance X1 of the gap 7, that is intentionally creating the gap 7 between the external electrode 2 and the bulb 3, is entirely beyond their assumption. In other words, according to a general idea of those who skilled in the art, the external electrode 2 should closely contact the bulb 3 as much as possible so that generation of the gap 7 is prevented.

First Embodiment

FIGS. 1 to 6 show a lamp or light source device 21 according to a first embodiment of the present invention. The light source device 21 comprises an air tight vessel or bulb 23 of which an inside functions as a discharge space 22, a discharge medium (not shown) sealed inside the bulb 23, an internal electrode (first electrode) 24, and an external electrode (second electrode) 25. The light source device 21 further comprises two holder members 27 for holding the external electrode 25 so that the external electrode 25 is opposed to the bulb 23 with a predetermined distance X1 of a space 26 therebetween. The light source device 21 further comprises a lighting circuit 31 for applying high frequency voltage to the discharge medium.

Figure 1:
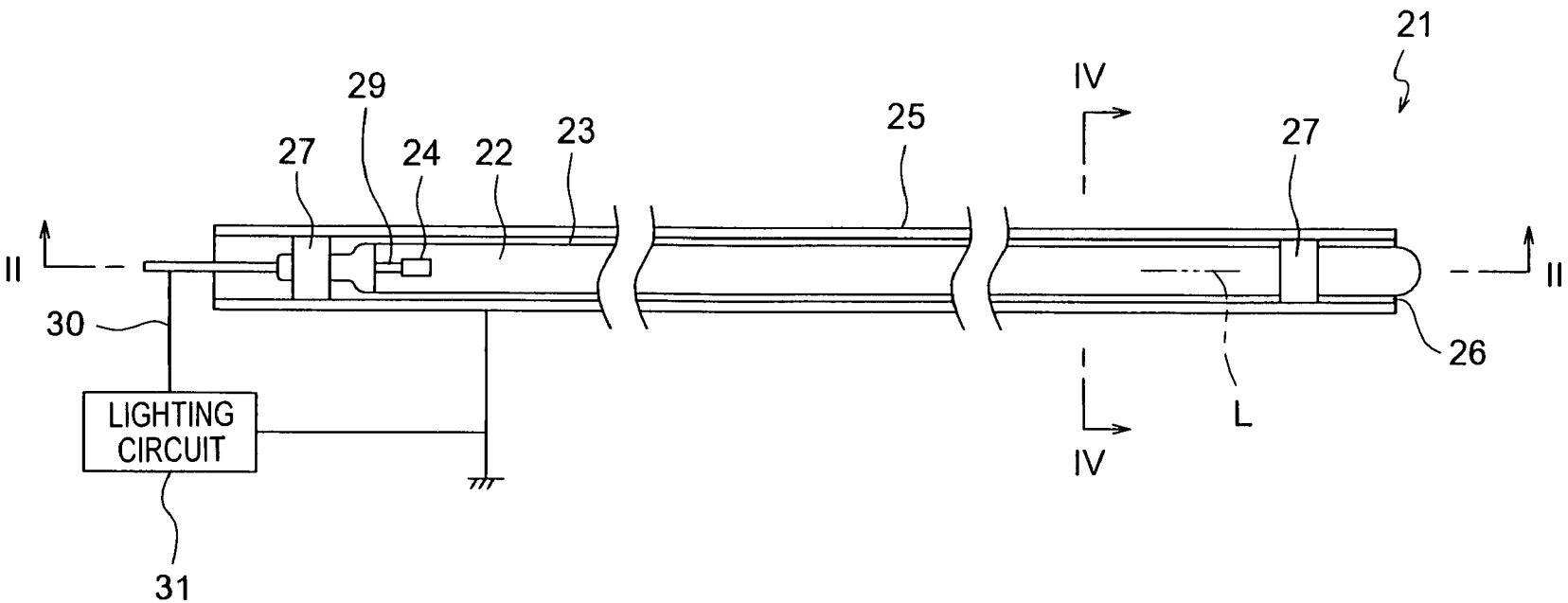
FIG. 1 is a plan view depicting a light source device according to a first embodiment of the present invention.
Figure 2:
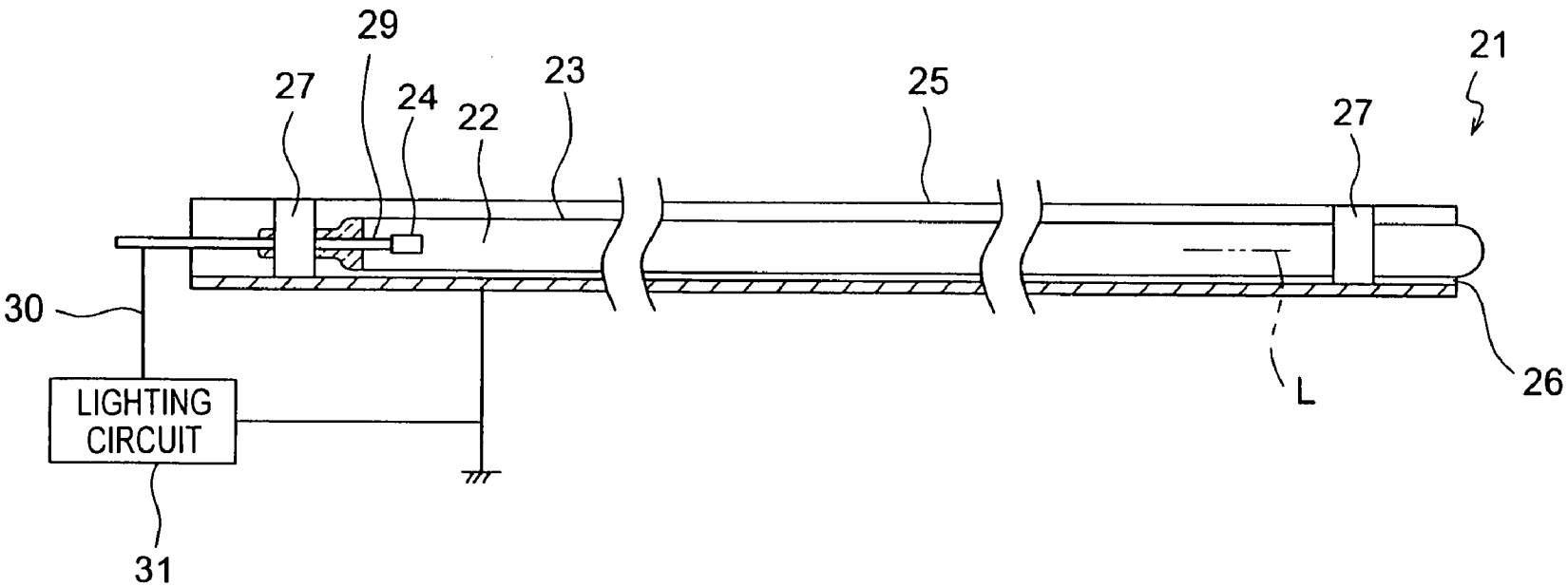
FIG. 2 is a cross-sectional view taken along line II-II in FIG. 1.
Figure 3:
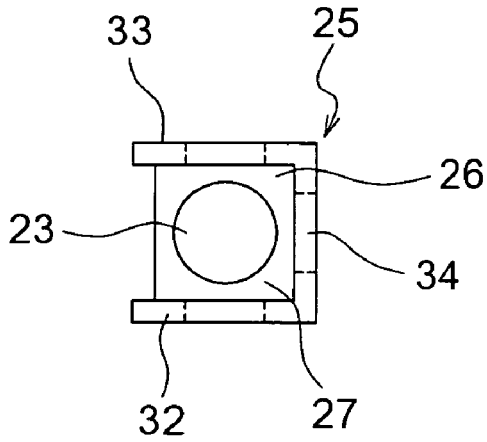
FIG. 3 is a right side view depicting the light source device according to the first embodiment of the present invention.
Figure 4:
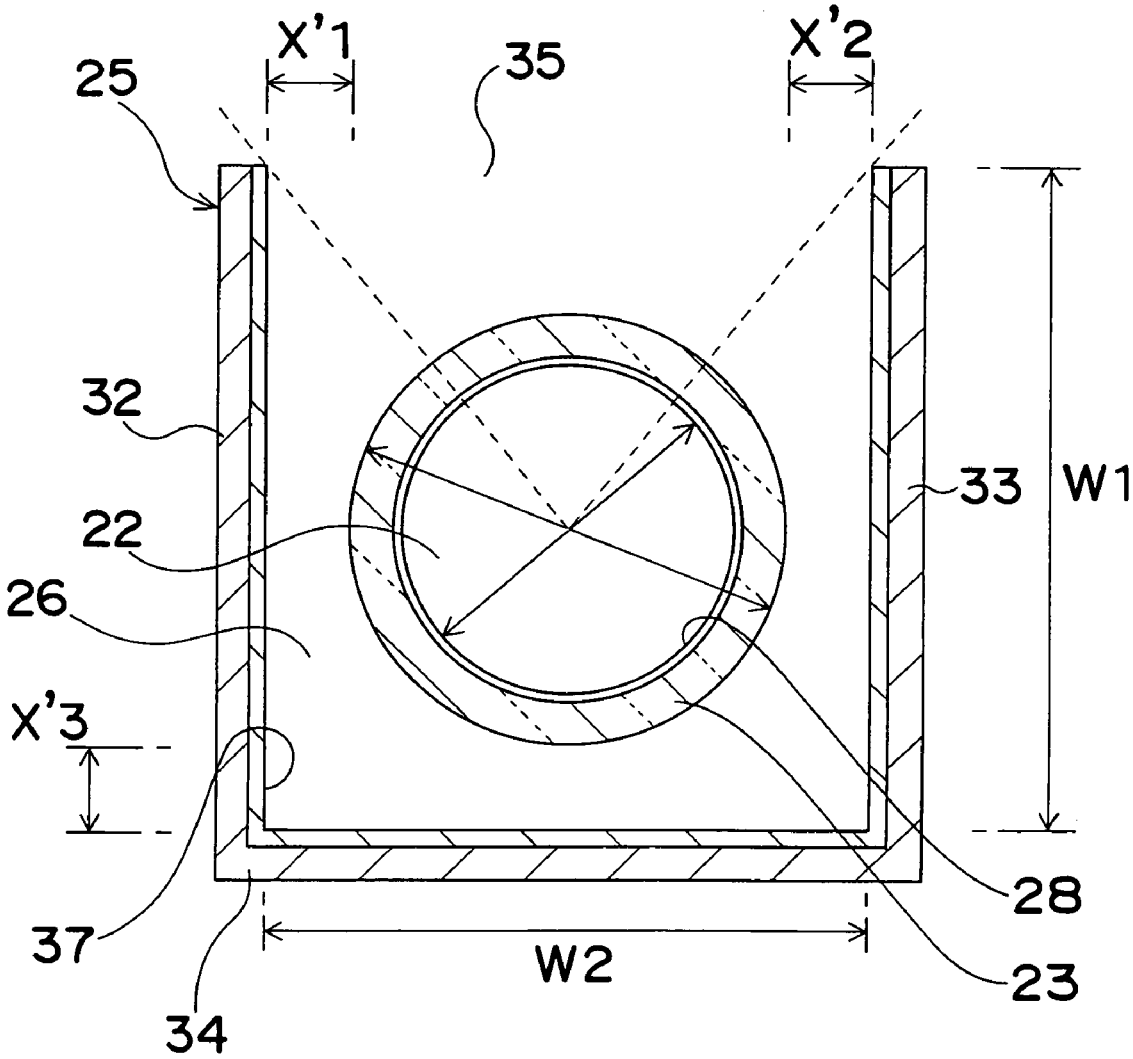
FIG. 4 is an enlarged view depicting a cross-section of the light source device perpendicular to an axis line according to the first embodiment of the present invention.

The bulb 23 has an elongated straight tubular shape extending along an axis line L thereof. As shown in FIGS. 3 and 4, a cross-section of the bulb 23 perpendicular to the longitudinal axis line L has a circular shape. The cross-sectional shape of the bulb 23, however, may be another shape, such as an ellipse, triangle or square. The bulb 23 need not have an elongated shape. The bulb 23 may be a shape other than straight tubular, such as an L-like shape, U-like shape or rectangular.

The bulb 23 is essentially made of material with transparency, such as borosilicate glass. The bulb 23 may be made of such glass as quartz glass, soda glass and lead glass, or organic matter such as acrylic. An outer diameter of the glass tube used for the bulb 23 is normally about 1.0 mm to 10 mm, but is not limited to this size. For example, the bulb 23 may be approximately 30 mm, which is common as a size of a fluorescent lamp for general-purpose illumination. A distance between an outer surface and an inner face of the glass tube, i.e. a thickness of the glass tube, is approximately 0.1 mm to 1.0 mm.

The bulb 23 is sealed, in which the discharge medium (not illustrated) is sealed. The discharge medium is one or more types of gas, mainly rare gas, but may contain mercury. The gas includes xenon, for example. Other rare gases, such as krypton, argon and helium, can be adopted. The discharge medium may contain a plurality of types of these rare gases. A pressure of the discharge medium sealed inside the bulb 23, i.e. an internal pressure of the bulb 23, is approximately 0.1 kPa to 76 kPa.

As shown in FIG. 4, a fluorescent layer 28 is formed on the inner surface of the bulb 23. The fluorescent layer 28 converts a wavelength of light emitted from the discharge medium. Depending on variation of material that constitutes the fluorescent layer 28, lights with various wavelengths, such as white light, red light, and green light, can be acquired. The fluorescent layer 28 can be formed with material used for general-purpose fluorescent lamps and plasma displays.

The internal electrode 24 is disposed at one end inside the bulb 23. The internal electrode 24 is comprised of such metal as tungsten or nickel. A surface of the internal electrode 24 may be partially or entirely covered by such a metal oxide layer as cesium oxide, barium oxide or strontium oxide. By using such a metal oxide layer, a lighting start voltage can be decreased, and deterioration of the internal electrode by ion impact can be prevented. A surface of the internal electrode 24 may be covered by a dielectric layer (e.g. glass layer). A conductive member 29 has a distal end to which the internal electrode 24 is provided and a proximal end disposed outside the bulb 23. The conductive member 29 is electrically connected to the lighting circuit 31 via lead wires 30.

The external electrode 25 is comprised of conductive material such as metal including copper, aluminum and stainless steel. Further, the external electrode 25 is grounded. As described later in detail, the external electrode 25 may be a transparent conductor of which a main component is tin oxide and indium oxide. In the present embodiment, the external electrode 25 has an elongated shape extending along a direction of the axis line L of the bulb 23. As most clearly shown in FIG. 4, a cross-section of the external electrode 25, perpendicular to the axis line L, has a U-like shape or a square shape of which one side is removed. Specifically, the external electrode 25 comprises a pair of flat first wall sections 32 and 33, and a second wall section 34 which links these first wall sections 32 and 33. Straight tubular bulb 23 is disposed in a space surrounded by these wall sections 32 to 34 of the external electrode 25. In other words, the wall sections 32 to 34 of the external electrode 25 surround the bulb 23. Specifically, as most clearly shown in FIG. 4, the first wall sections 32 and 33 are opposed to each other with the bulb 23 therebetween, and the second wall section 34 is opposed to an open section 35 with the bulb 23 therebetween.

As shown in FIG. 4, a reflection layer 37 is formed on an inner surface (surface opposite to the bulb 23) of each wall section 32 to 34 of the external electrode 25. The reflection layer 37 may be a layer made of material with high reflectance and formed on each wall section 32 to 34, or may be the surface of each wall section 32 to 34 itself which has high reflectance. The reflection layer 37 may be formed by polishing surfaces of the wall sections 32 to 34. As described later in detail, by being provided with the reflection layer 37, the external electrode 25 also functions as a reflection member.

In the light source device 21, a dielectric barrier discharge is generated between the internal electrode 24 and the external electrode 25 by applying an internal voltage using the lighting circuit 31, resulting in that the discharge medium is excited. This excited discharge medium emits ultraviolet light when moving back to a ground state. The ultraviolet light is transformed to visible light by the fluorescent layer 13, and then the visible light is emitted from the bulb 23.

Figure 5:
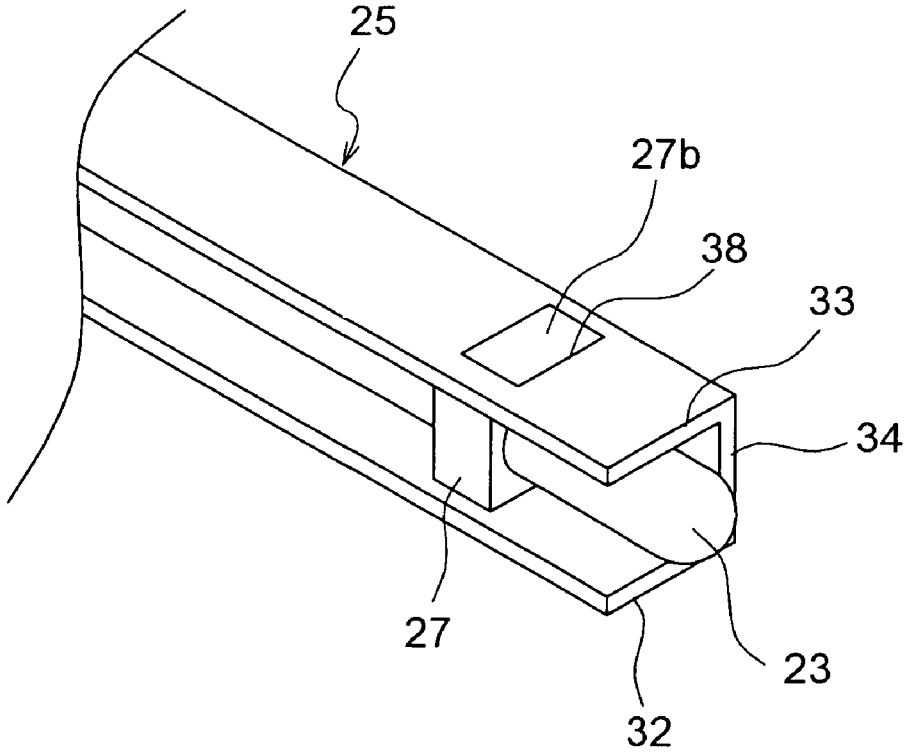
FIG. 5 is a partial enlarged perspective view of the light source device according to the first embodiment of the present invention.
Figure 6A:
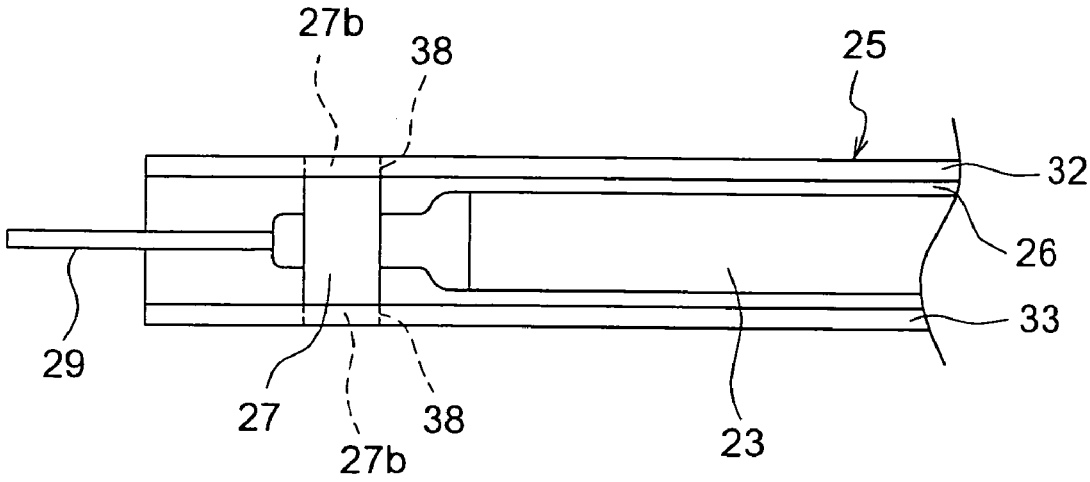
FIG. 6A is a partial enlarged view of FIG. 1.
Figure 6B:
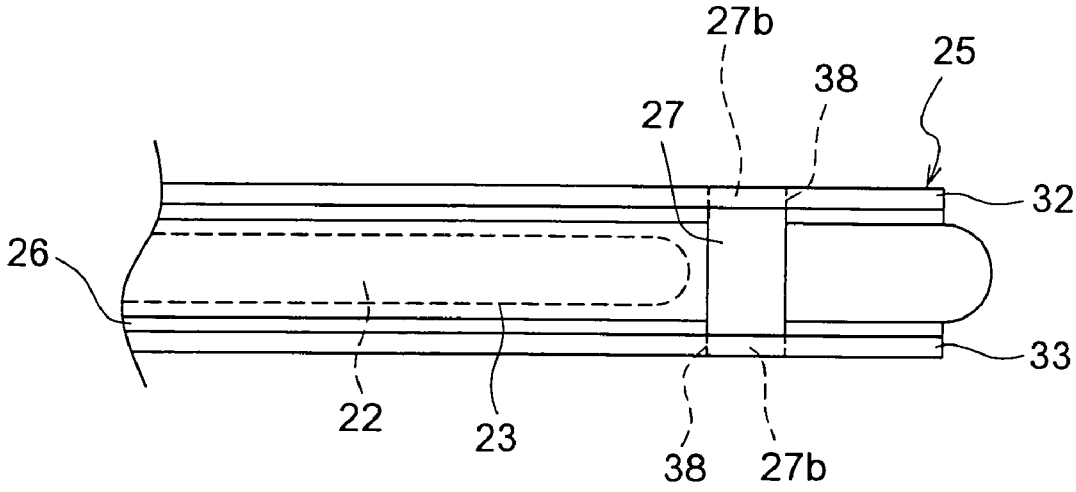
FIG. 6B is another partial enlarged view of FIG. 1.
Figure 7:
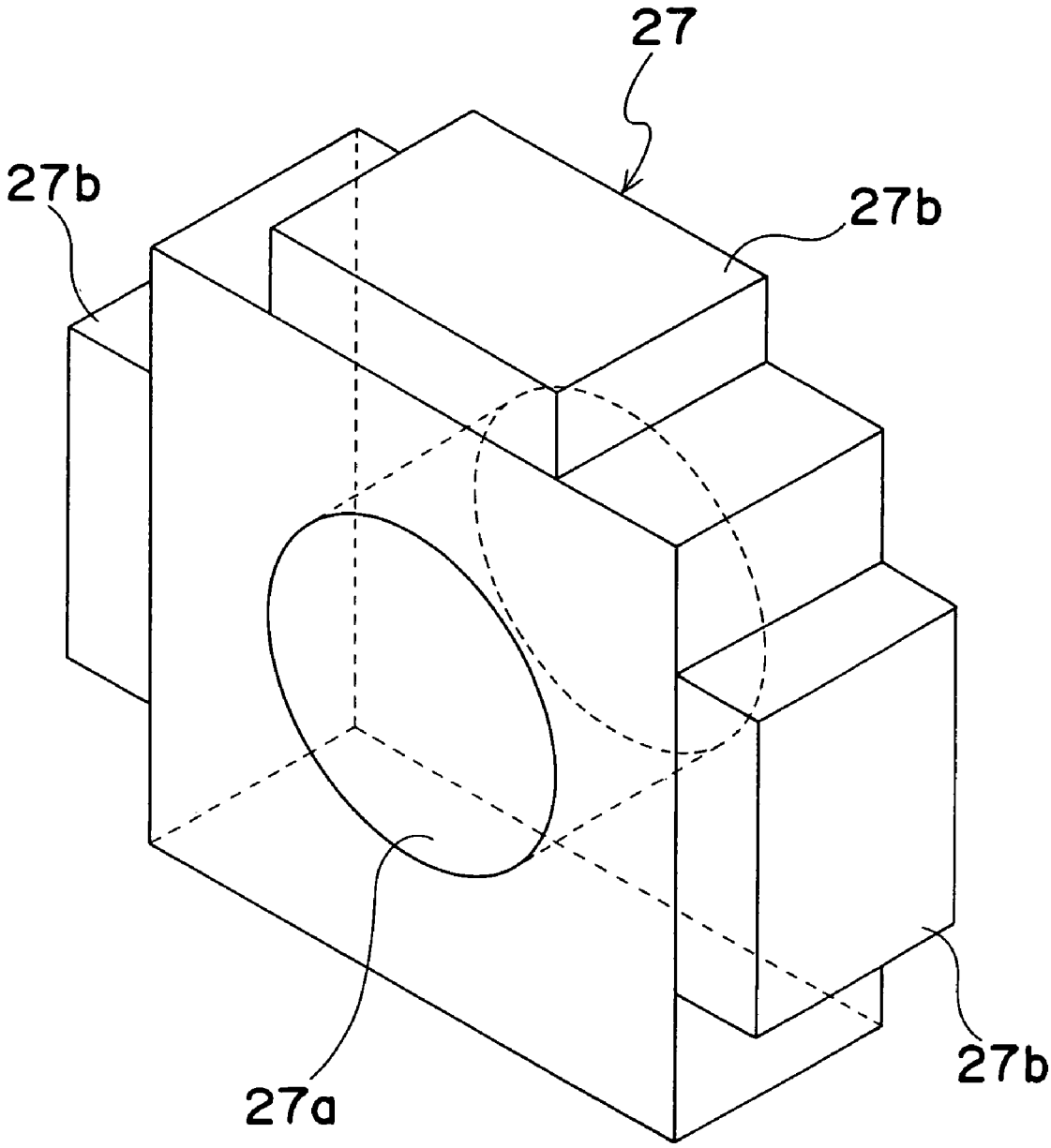
FIG. 7 is a perspective view depicting a holder member.

Next, a supporting structure of the external electrode 25 relative to the bulb 23 will be described. As described above, the external electrode 25 is secured to the bulb 23 by two holder members 27. Each holder member 27 is made of a material with insulation and elasticity, such as silicon rubber. As shown in FIG. 7, the holder member 27 is a relatively flat rectangular parallelepiped, wherein a circular support hole 27*a* penetrates at a center of the holder member 27. The bulb 23 is inserted into the support hole 27*a*, and the holder member 27 is secured to the bulb 23 by a hole wall of the support hole 27*a* elastically tightening over an outer surface of the bulb 23. A rectangular parallelepiped engagement protrusion 27*b* is disposed on each of three of four side faces of the holder member 27, excluding one side face corresponding to the open section 35 of the external electrode 25. As shown in FIGS. 5 to 6B, a rectangular engagement hole 38 is formed in the walls sections 32 to 34 respectively on both ends in the longitudinal direction of the external electrode 25. By the engagement protrusions 27*b* fitting into the engagement holes 38, the external electrode 25 is secured to the holder member 27. As most clearly shown in FIG. 6B, the holder member 27 is disposed at a position away from an area where the discharge space 22 and the external electrode 25 are opposed to each other.

As most clearly shown in FIG. 4, a space 26 is provided between the outer surface of the bulb 23 and the external electrode 25. In other words, the bulb 23 does not contact the external electrode 25 throughout an entire axis line L direction. Specifically, the outer surface of the bulb 23 is opposed to each of wall sections 32 to 34 of the external electrode 25 with distances X'1, X'2 and X'3 therebetween.

In the present embodiment, the distances X'1, X'2 and X'3 between the wall sections 32 to 34 of the external electrode 25 and the outer surface of the bulb 23 are respectively constant in the direction of the axis line L. Further, the distances X'1, X'2 and X'3 are the same as one another. However, the distance between the external electrode 25 and the bulb 23 need not be constant in the direction of the axis line L as long as the distance is within a range between a later mentioned shortest distance and longest distance. Further, the distance between the external electrode 25 and the bulb 23 in a circumferential direction of the bulb 23 as well need not be constant.

As described above, the gap between the external electrode and the bulb is inevitably generated even if it is tried to contact the external electrode with the bulb by a physical method or a chemical method. Further, the gap destabilizes light emission intensity and causes a dielectric breakdown of atmospheric gas. Contrary to this, the present invention completely departs from the conventional technical common knowledge owned by those skilled in the art, which is that the external electrode must contact the bulb as closely as possible. That is, according to the present invention, the space 26 is intentionally provided between the external electrode 25 and the outer surface of the bulb 23 in order to intentionally separate the external electrode 25 and the bulb 23 from each other. Therefore even if a spatial relationship between the external electrode 25 and the bulb 23 is slightly changed, this shift has only small influence on the distances, X'1, X'2 and X'3 of the space 26 between the external electrode 25 and the bulb 23. In other words, even if the spatial relationship between the external electrode 25 and the bulb 23 is slightly changed, the external electrode 25 can maintain a status of being separated from the bulb 23. This results in stable power supply to the bulb 23, which achieves remarkably stable emission intensity. Further, as described later, by appropriately setting the distances X'1 to X'3 of the space 26, prevented can be that an excessive voltage is applied to the space 26 and that a dielectric breakdown of the atmospheric gas (air in the present embodiment) filled in the space 26 occurs.

Then, quantitative settings of the distances X'1, X'2 and X'3 of the space 26 between the external electrode 25 and the bulb 23 will be described in detail. In the following description, the distances X'1, X'2 and X'3 between the outer surface of the bulb 32 and each of wall sections 32 to 34 of the external electrode 25 are collectively referred to as a "distance X1 of the space 26".

Referring again to FIGS. 32A and 32B, the space 26 and a solid dielectric layer 40, including the wall of the bulb 23, exist between the external electrode 25 and the discharge space 22. The space 26 and the solid dielectric layer 40 can be regarded as equivalent to the capacitors 41 and 42 connected in series.

Regarding the electric charge Q stored in the capacitors 41 and 42, following equation (5) is established.

$$Q=C0\cdot V=C1\cdot V1=C2\cdot V2 \tag{5}$$

In this equation, "C1" and "C2" denote capacitances of the capacitors 41 and 42, "C0" denotes combined capacitance of the capacitors 41 and 42, "V1" denotes a voltage applied to the space 26, "V2" denotes a voltage applied to the solid dielectric layer 40, and "V" denotes a voltage applied between the discharge space 22 and the external electrode 25.

The voltage V1 applied to the space 26, the voltage V2 applied to the solid dielectric layer 40, the voltage V applied between the discharge space 22 and the external electrode 25, electric field E of the space 26, and electric field E' of the solid dielectric layer 40 have relationships defined by following equations (6) to (8).

$$V=V1+V2 \tag{6}$$

$$E=\frac{V1}{X1} \tag{7}$$

$$E'=\frac{V2}{X2} \tag{8}$$

From equations (5) to (7), following equation (9) is obtained.

$$E = \frac{V1}{X1} = \frac{C2 \cdot V}{(C1 + C2) \cdot X1} \quad (9)$$

By applying afore-mentioned equation (1) to equation (9), following equation (10) regarding the electric field E of the space 26 is obtained.

$$E = \frac{\varepsilon 2 \cdot V}{(\varepsilon 2 \cdot X1 + \varepsilon 1 \cdot X2)} \quad (10)$$

In the present embodiment, since air that has a dielectric constant of 1 is filled in the space 26, following equation (10)' is established.

$$E = \frac{\varepsilon 2 \cdot V}{(\varepsilon 2 \cdot X1 + X2)} \quad (10)'$$

If a dielectric breakdown electric field of the space 26 is "E0", following equation (11) needs to be established in order to prevent an occurrence of dielectric breakdown in the space 26.

$$E0 > E \quad (11)$$

By applying equation (10) to equation (11), following inequality (12) is obtained.

$$X1 > \frac{V}{E0} - \frac{\varepsilon 1}{\varepsilon 2} \times X2 \quad (12)$$

If the space 26 is filled with air (∈1=1), following inequality (12)' is established.

$$X1 > \frac{V}{EO} - \frac{X2}{\varepsilon 2}, \quad (12)$$

Therefore, in order to prevent dielectric breakdown in the space 26, the distance X1 of the space 26 needs to be set to be longer than a shortest distance X1L defined by following equation (13).

$$X1L = \frac{V}{EO} - \frac{\varepsilon 1}{\varepsilon 2} \times X2 \quad (13)$$

Especially, when air is filled in the space 26, the shortest distance X1L is defined by following equation (13)'.

$$X1L = \frac{V}{EO} - \frac{X2}{\varepsilon 2}, \quad (13)$$

The distance X1 of the space 26 set to be longer than the shortest distance X1L prevents dielectric breakdown of the atmospheric gas filled in the space 26 and damage to peripheral members due to gas molecules ionized by the dielectric breakdown. In the present embodiment, since the atmospheric gas is air, prevented is ozone being generated by the dielectric breakdown which causes damage to the peripheral members.

A longest distance of the distance X1 of the space 26 can be determined according to a condition where the light source device can be lit by reasonable input power. In other words, if the distance is excessively long, the input power in order to activate the light source device should be set excessively high, which is impractical.

If the atmospheric gas filled in the space 26 is air (which has the dielectric constant of 1) as in the present embodiment, it is preferable that the distance X1 of the space 26 is set to be not less than 0.1 mm and not more than 2.0 mm. A lower limit (0.1 mm) of the distance X1 is determined by equations (13) and (13)'. For an upper limit of the distance X1, a maximum voltage between the internal electrode 24 and the external electrode 25 is approximately 5 kV, and the distance X1 of the space 26 should be set to approximately 2.0 mm at maximum in order that a voltage of approximately 5 kV generates discharge in the bulb 23.

Next, luminous efficiency will be described. As described with reference to equations (1) to (4), the distance X1 of the space 26 set to be long, that is disposing the external electrode 25 away from the bulb 23, causes a decrease in luminous efficiency. In the present embodiment, however, an area S of the external electrode 25 that covers the bulb 23 is set to be large so as to compensate for the decrease in the luminous efficiency due to existence of the space 26, and to achieve high luminous efficiency. Specifically, as understood by equations (3) and (3)', increasing the area S of the external electrode 25 increases the combined capacitance C0, thereby the luminous efficiency improves as understood by equation (4).

It should be noted that the space 26 arranged between the external electrode 25 and the bulb 23 makes it possible to enhance the luminous efficiency by increasing the area S of the external electrode 25. In case the external electrode 2 contacts the bulb 3 as the light source device shown in FIG. 31A, an aperture ratio of the bulb 3 decreases as an area of the external electrode 2 increases. This decreased aperture ratio causes light emitted from the bulb 3 to be reflected by the external electrode 2 back to the bulb, and then absorbed. As a result, a light output from the bulb 3 decreases, which results in that virtual or nominal luminous efficiency is decreased. A decrease in the luminous efficiency due to a decrease in the aperture ratio cancels an effect of increasing the luminous efficiency by an increase in the combined capacitance. Contrary to this, according to the present embodiment, the external electrode 25 is disposed not on the outer surface of the bulb 23 but separately from the bulb 23 with the space 26 therebetween. Therefore, increasing area S of the external electrode 25 does not cause a decrease in an aperture ratio of the bulb 23. This remarkably decreases a ratio of the light reflected by the external electrode 25 and returned to the bulb 23 with respect to total light emitted from the bulb 23. In other words, since the external electrode 25 is disposed separately from the bulb 23 via the space 26, light emitted from the bulb 23 is efficiently reflected by the reflection layer 37 of the external electrode 25, and is output from the light source device 21.

In order to increase the luminous efficiency it is preferable that an elevation angle θ (see FIG. 4), which is an angle when the external electrode 25 is viewed from the axis line L of the bulb 23, is at least 10 degrees. This is because if the elevation angle θ is less than 10 degrees, discharge generated inside the bulb 23 may concentrate and shrink at a part of the discharge space 22 near the external electrode 25, resulting in decrease in an excitation efficiency of the discharge medium that causes decrease in the luminous efficiency of the light source device 21. For example, compared with a case where the elevation angle θ is 1 degree, the luminous efficiency of the light source device 300 may be at least 1.5 times if the elevation angle θ is 90 degrees. This was confirmed by the present inventor by evaluating difference in the luminous efficiency between a case where a width in a tube diameter direction of the external electrode 25 is approximately 0.035 mm and a case where the width is approximately 3 mm, using external electrode 25 having a strip shape (see FIG. 14A and FIG. 14B) and made of a transparent conductor with the bulb 23 having an outer diameter of 3 mm. An upper limit of the elevation angle θ is not especially limited, but if second electrode or external electrode 25 is disposed throughout 360 degrees, that is, throughout an entire circumference of the bulb 3, a part or all of the external electrode 25 must be formed as a transparent electrode (see fourth embodiment described later).

If a shape of the cross-section of the bulb 23 perpendicular to the axis line L has a circular shape, as in this embodiment, it is preferable for improvement of the luminous efficiency that a cross-section of the external electrode 25 perpendicular to the axis line L has a shape except for a concentric circle with respect to the cross-sectional shape of the bulb 23. A cross-sectional shape that is not a concentric circle reduces a ratio of light which is reflected back to the bulb 23 by the external electrode 25 with respect to total light emitted from the bulb 23, thereby improving luminous efficiency. In the present embodiment, by having a U-like shape as described with reference to FIG. 4, the cross-sectional shape of the external electrode 25 perpendicular to the axis line L is not a concentric circle with respect to the cross-sectional shape of the bulb 23.

The external electrode 25 is separated from the bulb 23 not by a solid layer such as a solid dielectric layer, but by the space 26 in which gas (air in the present embodiment) is filled. A first reason for this arrangement is that if the external electrode is separated from the bulb by a solid layer such as a solid dielectric layer, micro-air portions such as air bubbles exist in a boundary between the solid layer and the external electrode. Similar micro-air portions also exist in a boundary between the solid layer and the bulb. These micro-air portions cause dielectric breakdown that generates ozone, thereby causing damage to peripheral members.

A second reason for the arrangement is that a low-profile or small light source device with lighter weight can be achieved. As is clear by above-mentioned equation (11), it is necessary to decrease the electric field E of the space 26 for prevention of dielectric breakdown. A spatial separation of the external electrode and the bulb by the solid layer corresponds to an increase in the thickness X2 of the solid dielectric layer in the denominator on the right-hand side of equation (10)' indicating the electric field E of the space 26. A coefficient by which the thickness X2 is multiplied in the denominator on the right-hand side of equation (10)' is 1 ($\in 1=1$). On the other hand, a coefficient by which the distance X1 of the space 26 is multiplied in the denominator on the right-hand side of equation (10)' is dielectric constant $\in 2$ of the solid dielectric layer, which is greater than 1. Therefore, in order to effectively decrease the electric field E of the space 26, it is more efficient to increase the distance X1 of the space 26 rather than to increase the thickness X2 of the solid dielectric layer. Therefore, separating the external electrode 25 from the bulb 23 by the space 26 can achieve a light source device with a low-profile or small and lighter weight more effectively than providing a solid layer such as a solid dielectric layer.

Although, in the present embodiment, the reflection layer 37 is formed on the external electrode 25, the reflection layer 37 is not an essential feature. However, if mirror-finishing for visible light has been applied to the external electrode 25, luminous efficiency may become 15% higher compared to a case in which diffused reflection finishing has been applied.

Owing to the space 26 provided between the bulb 23 and the external electrode 25 by the holder member 27, the light source device 21 of the present embodiment can adopt an arbitrary shape of the bulb 23. Owing to that the external electrode 25 does not contact the bulb 23, a shape and the structure of the external electrode 25 can be simplified. Owing to the reflection layer 37 formed on the external electrode 25, a function as a reflection element can be provided to the external electrode 25. In other words, since a dedicated reflection element other than the external electrode 25 is unnecessary, a number of composing elements can be decreased. Therefore, the light source device 21 is simple, inexpensive, and easy to manufacture.

(Experiment)

Concerning the light source device 21 of the first embodiment, an experiment for confirming an ozone generation suppression effect (first experiment) and an experiment for confirming luminous efficiency (second experiment) were conducted.

Figure 8:
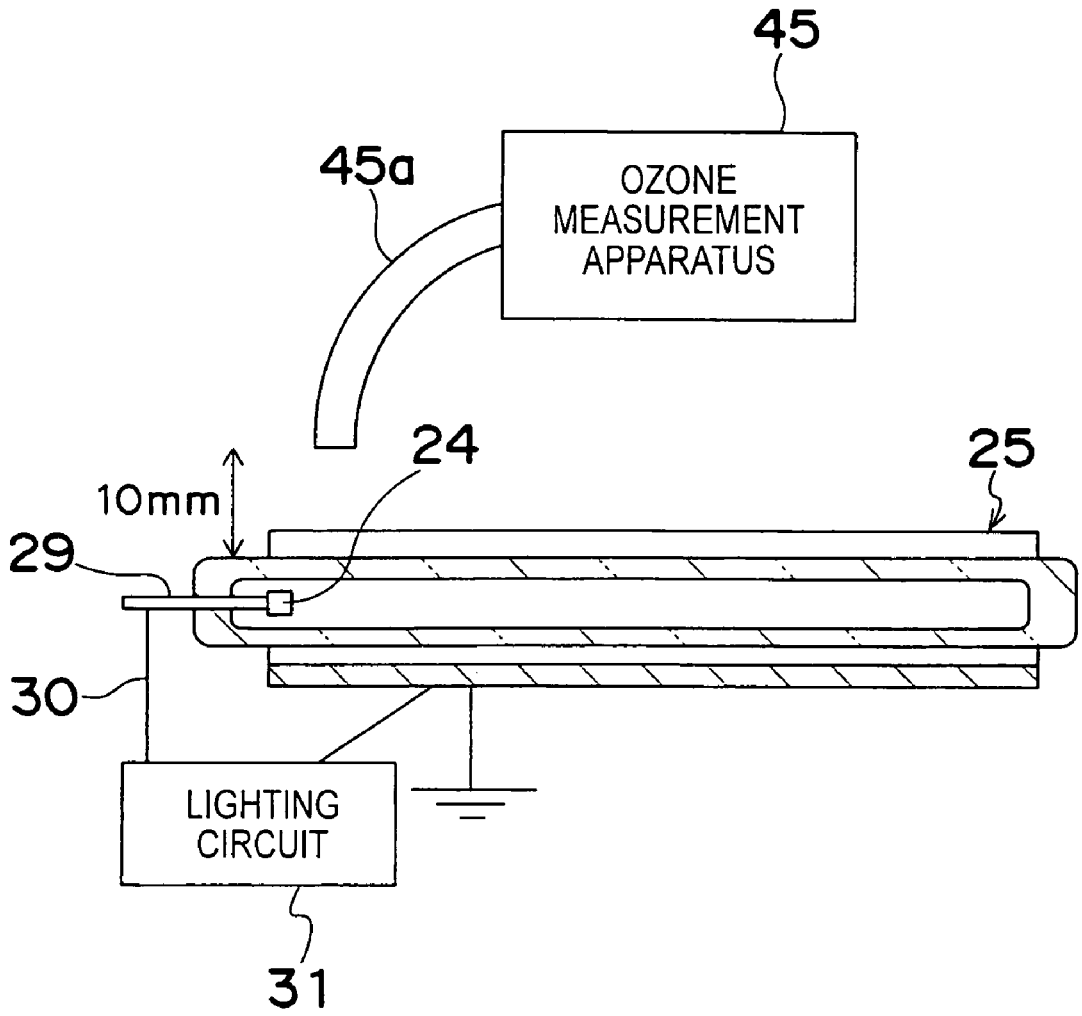
FIG. 8 is a schematic diagram depicting an ozone measurement method.

With reference to FIG. 8, in the first experiment, a tip of a nozzle 45*a* of an ozone measurement device 45 is positioned 10 mm above the bulb 23 for measuring ozone quantity. Two types of light source device 21 of the first embodiment (first and second experiment examples) were provided for the first experiment. Ozone measurements were performed for each of the first and second experiment examples while changing the distance X'3 between the bulb 23 and the wall section 34 of the external electrode 25. Experimental conditions of the first experiment example were as follows:

Dimensions of bulb 23: outer diameter OD: 2.6 mm, inner diameter ID: 2.0 mm, length: 165 mm;

Material of bulb 23: borosilicate glass (dielectric constant is 5);

Discharge medium: mixed gas of 60% Xe and 40% Ar (160 Torr);

Material of internal electrode 24: tungsten;

Dimensions of internal electrode 24: diameter: 0.3 mm, length: 3 mm;

Material of external electrode 25: aluminum;

Dimensions of external electrode 25: thickness of wall sections 32 to 34: 0.3 mm, width W of wall sections 32 and 33: 14.0 mm, width W of wall section 34: 23.6 mm, length: 165 mm;

Distance between external electrode 25 and internal electrode 24: distances X'1 and X'2 are 0.5 mm (constant), distance X'3 (variable);

Dielectric breakdown field of air: about 10 kV/mm (measured value);

Drive waveform: rectangular wave created by inverter

Drive frequency: 28 kHz; and

Drive voltage: +2 kV, −2 kV (4 kV amplitude).

Experimental conditions of the second experiment example are the same as the experimental conditions of the first experiment example, except that the outer diameter OD of the bulb 23 is 3.0 mm, the inner diameter ID is 2.0 mm, the length of the bulb 23 and the external electrode 25 is 210 mm, and the distances X'1, X'2 and X'3 are 0.3 mm.

Figure 9:
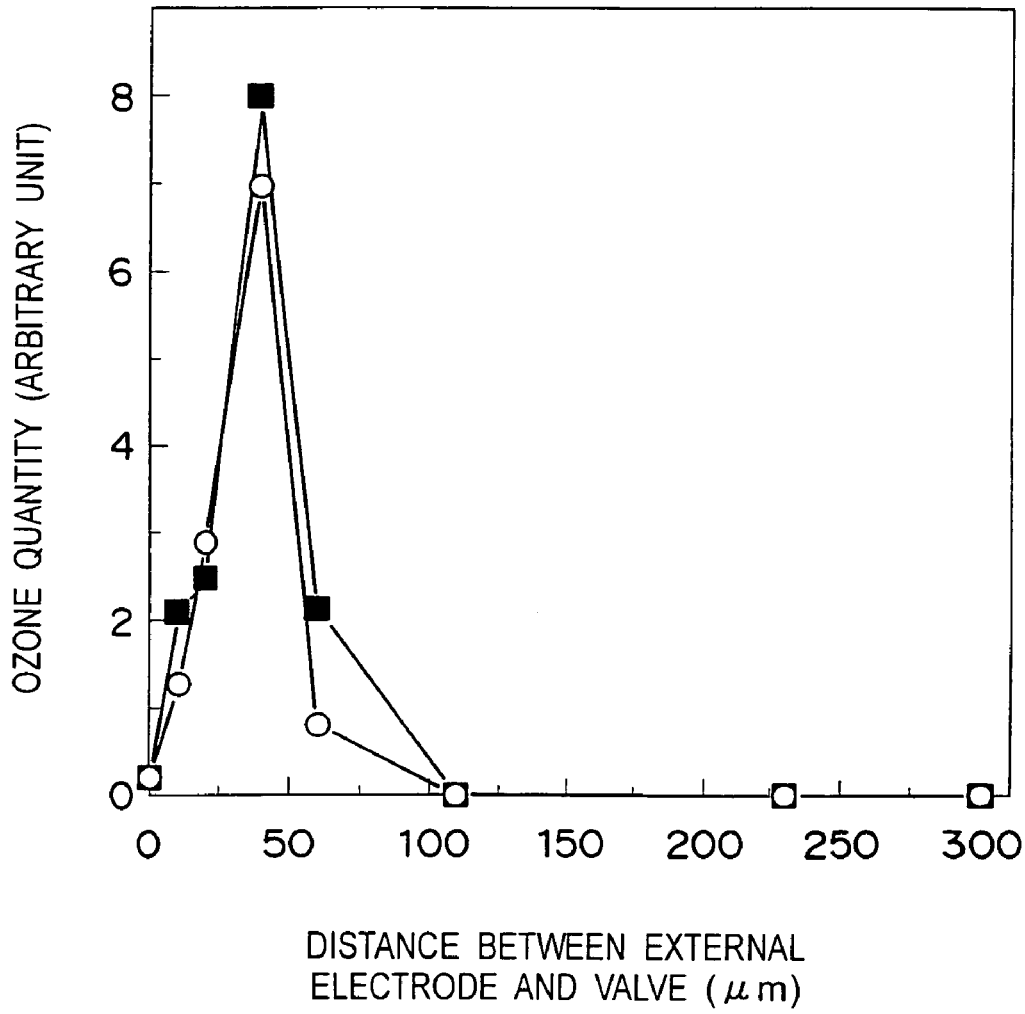
FIG. 9 is a graph depicting a relationship of a distance between an external electrode and a bulb and ozone quantity.

FIG. 9 shows results of ozone quantity measurements of the first and second experiment examples. In FIG. 9, "■" indicates the first experiment example, and "○" indicates the second experiment example.

For both the first and second experiments, it was confirmed that ozone is hardly generated when the distance X'3 increases to approximately 0.1 mm (100 μm).

By substituting numeric values corresponding to the first and second experiment examples into equation (13)', shortest distance X1L was calculated. As a result, shortest distance X1L of the first experiment example was 0.14 mm, and the shortest distance X1L of the second experiment example was 0.10 mm. These calculation results approximately match experiment results of the first and second experiment examples shown in FIG. 9. Thus, setting the distance X1 between the external electrode 25 and the bulb 23 based on the shortest distance X1L determined by equations (13) and (13)' can prevent ionization of the atmospheric gas by dielectric breakdown.

Figure 10A:
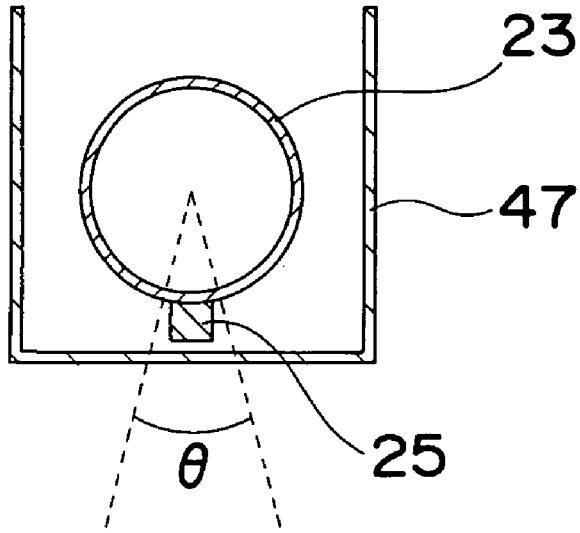
FIG. 10A is a schematic cross-sectional view depicting a light source device according to a first comparison example.
Figure 10B:
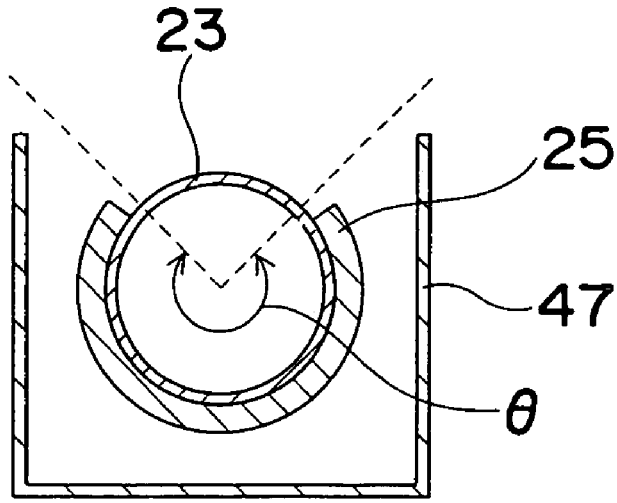
FIG. 10B is a schematic cross-sectional view depicting a light source device according to a second comparison example.

In the second experiment, a total luminous flux of the light source device was measured for the above-mentioned first experiment example (elevation angle θ is approximately 280 degrees) with changing input voltage. As a first comparison example, a light source device shown in FIG. 10A was subject to the second experiment. The light source device shown in FIG. 10A has a strip type external electrode 25 (elevation angle θ is about 25 degrees) formed so as to closely contact an outer surface of bulb 23 as shown in FIG. 10A. Further, as a second comparison example, a light source device shown in FIG. 10B was subject to the second experiment. The light source device shown in FIG. 10B has an external electrode 25 (elevation angle θ is about 280 degrees) formed so as to closely contact and surround an outer surface of bulb 23. For each of the first and second comparison examples, a reflection element 47 having the same shape and size as the external electrode 25 of the first experiment example and made of insulation material was used. A relative positional relationship between the bulb 23 and the reflection element 47, such as a distance from the bulb 23 to the reflection element 47, is the same as a relative positional relationship between the bulb 23 and the external electrode 25 in the first experiment example.

Figure 11:
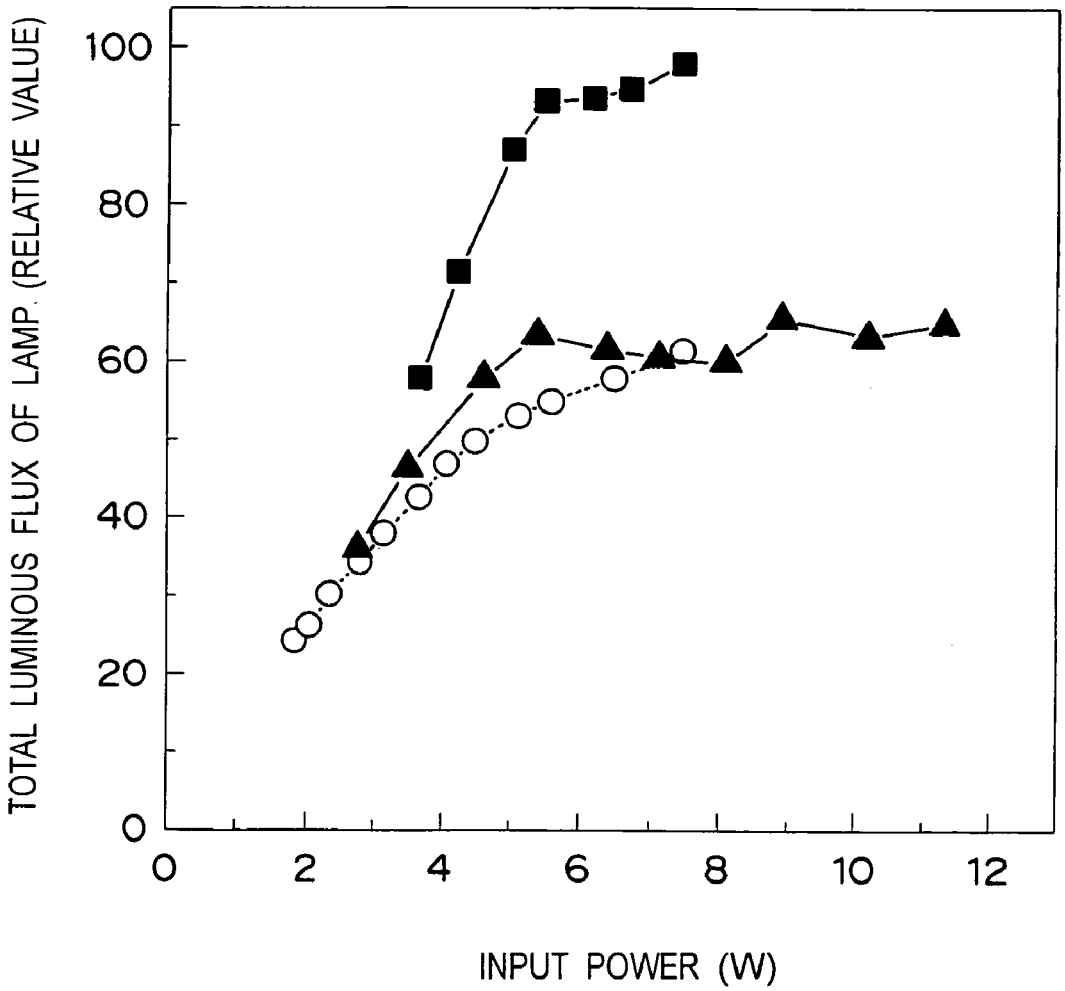
FIG. 11 is a graph depicting a relationship between input power and total luminous flux of a lamp.

FIG. 11 shows total luminous flux measurement results for the first experiment example and the first and second comparison examples. In FIG. 11, "■" indicates a measurement result of the first experiment example. Further, "▲" indicates a measurement result of the first comparison example. Furthermore, "○" indicates a measurement result of the second comparison example.

Compared with the measurement result of the first comparison example, total luminous flux in the second comparison example hardly increases, and rather tends to decrease. Therefore, it is confirmed that the external electrode formed so as to contact the outer face of the bulb 23 does not increase the luminous efficiency, even if the elevation angle θ is increased, that is even if the area of the external electrode is increased.

Compared with the measurement result of the first comparison example, the total luminous flux in the first experiment example remarkably increases. Particularly, when an input voltage is approximately 7 W, the total luminous flux of the first experiment example increases approximately 1.7 times the total luminous flux in the first comparison example. Therefore, it is confirmed that when the space 26 is provided between the external electrode 25 and the bulb 23, the luminous efficiency is increased by increasing the elevation angle θ, that is by increasing the area of the external electrode.

By the experiment result of the second experiment, it is confirmed that merely increasing the area of the external electrode does not increase the luminous efficiency, and that increasing the area of the external electrode with a precondition that the space 26 is provided between the external electrode 25 and the bulb 23 can achieve an increase of the luminous efficiency.

The arrangement where the space 26 is provided between the bulb 23 and the external electrode 25 is particularly effective when the internal electrode 24 is disposed at one end inside the external electrode 25 which is elongated along the axis line L of the bulb 23. A reason for this effectiveness will be described hereinbelow.

When the internal electrode 24 is at the end inside the bulb 23, high voltage needs to be supplied to the bulb 23 in order to allow light to emit from discharge medium between the internal electrode 24 and a part of the external electrode 25 positioned mostly away from the internal electrode 24. For example, in a case of the light source device of this embodiment, 2 kV of voltage needs to be supplied for this reason. By supplying such a high voltage, dielectric breakdown tends to occur between the bulb 23 and the external electrode 25 by the high voltage (maximum voltage) applied between the internal electrode 24 and a part of the external electrode 25 positioned most closely to the internal electrode 24. Contrary to this, when a distance between the internal electrode and the external electrode is approximately constant (e.g. in a case where both the internal electrode and the external electrode extend parallel to the axis line direction of the bulb), a necessary voltage for activating the light source device is approximately ⅙ of necessary voltage for activating the light source device of the present embodiment, i.e., approximately 300 V of a relatively low voltage. Therefore, for the arrangement where the internal electrode 24 is disposed at the end inside the bulb 23 and the external electrode 25 is elongated along the axis line L of the bulb 23, as the present embodiment, a voltage for activation needs to be equal to at least six-times the voltage for activating the arrangement where the distance between the internal electrode and the external electrode is constant. For such high supplied voltage, prevention of dielectric breakdown by the space 26 provided between the bulb 23 and the external electrode 25 works more effectively than the arrangement of the present embodiment.

Figure 12:
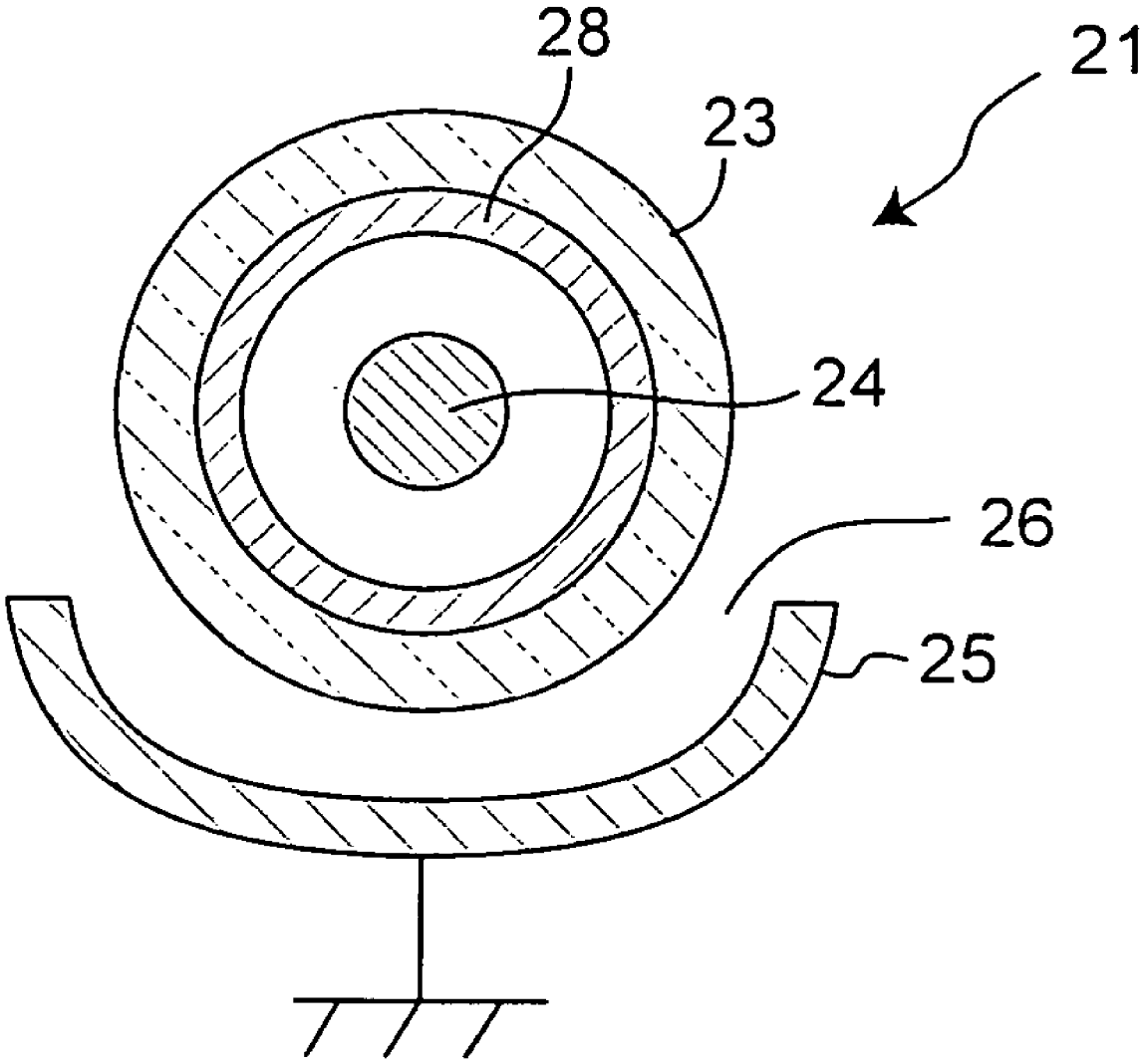
FIG. 12 is a schematic cross-sectional view depicting a modification of the first embodiment.
Figure 13B:
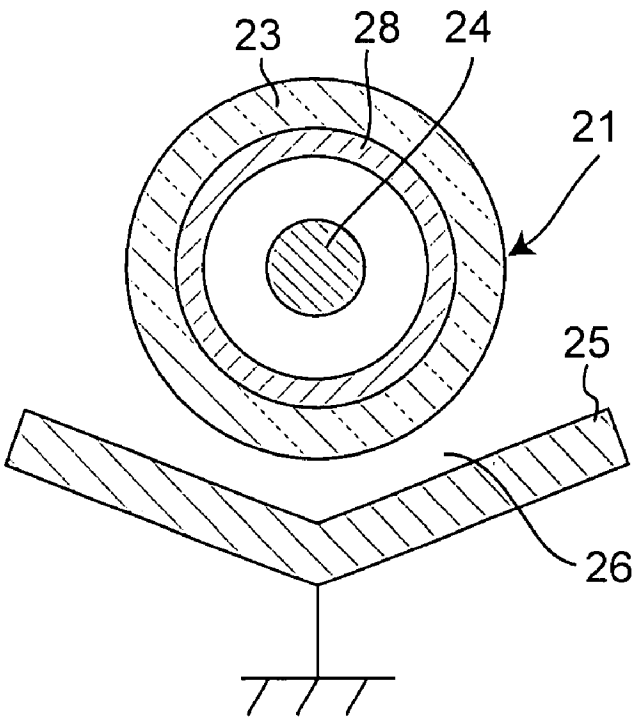
FIG. 13B is a cross-sectional view depicting a further modification of the first embodiment.
Figure 13A:
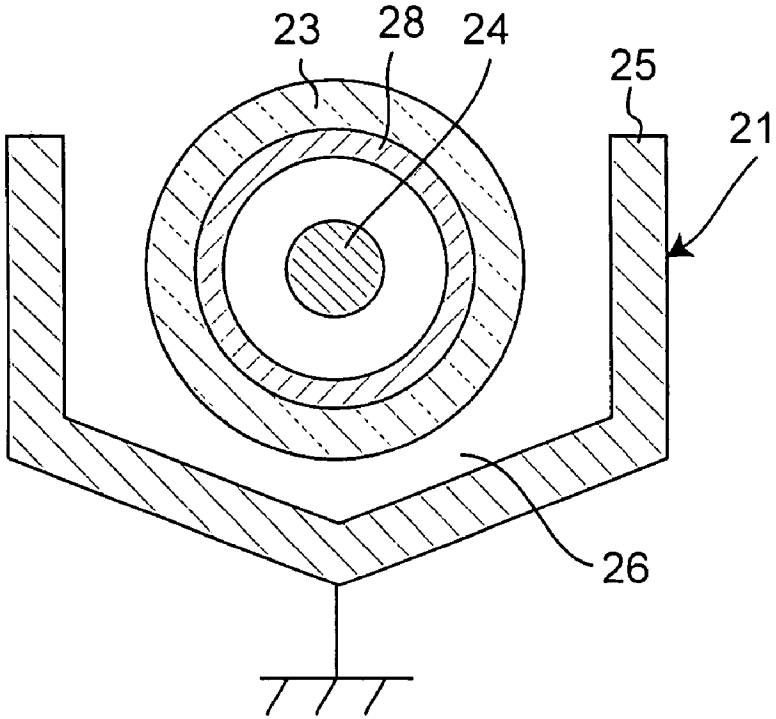
FIG. 13A is a cross-sectional view depicting another modification of the first embodiment.

FIGS. 12, 13A and 13B show modifications of the first embodiment. These modifications differ from the first embodiment only in a cross-sectional shape of the external electrode 25 perpendicular to the axis line L. Further, in these figures, the same elements as those of the first embodiment are denoted by the same reference symbols. Furthermore, in these figures, illustrations of holder member 27 and reflection layer 37 are omitted.

In the modification of FIG. 12, the cross-sectional shape of the external electrode 25 is a curve that is a part of an ellipse. In the modification of FIG. 13A, the cross-sectional shape of the external electrode 25 is a part of a pentagon comprising a pair of wall sections opposed to each other and a downward angle wall section which links the pair of wall sections. In the modification of FIG. 13B, the external electrode 25 has an angle cross-section. In these modifications, luminous efficiency is improved by the cross-sectional shape of the external electrode 25 that is not a concentric circle with respect to the cross-section of the bulb 23.

Second Embodiment

Figure 14A:
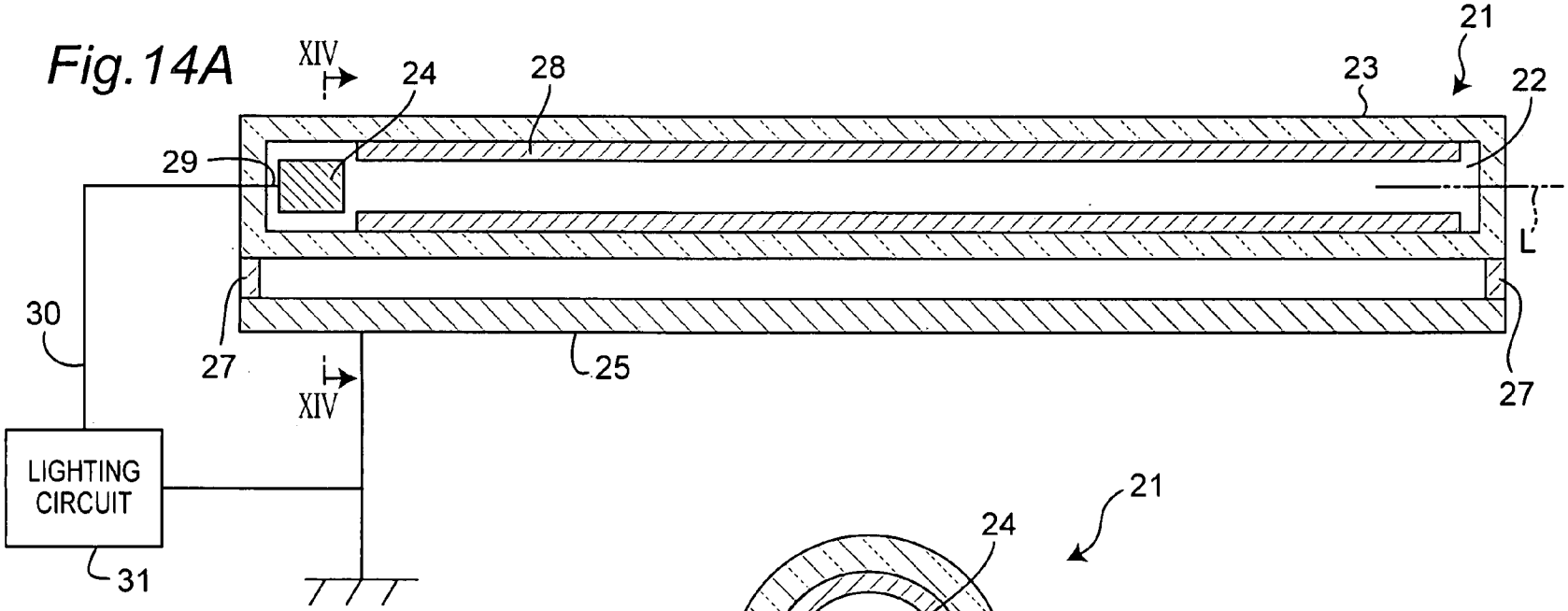
FIG. 14A is a cross-sectional view depicting a light source device according to a second embodiment of the present invention.
Figure 14B:
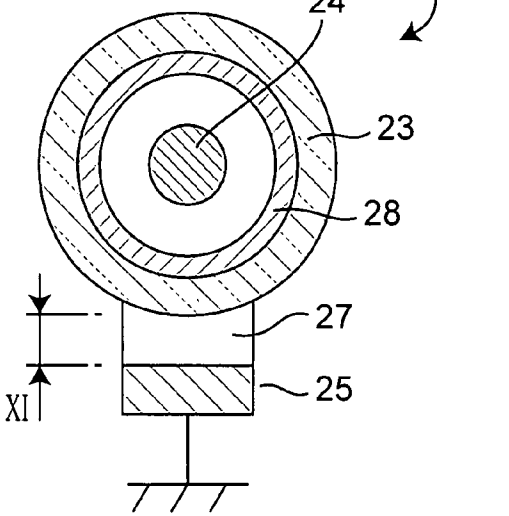
FIG. 14B is a cross-sectional view taken along line XIV-XIV in FIG. 14A.

A light source device 21 according to a second embodiment of the present invention shown in FIGS. 14A and 14B has external electrode 25 having a strip-like shape with constant width. Space 26 is created between the external electrode 25 and an outer face of bulb 23, and distance X1 of the space 26 is set to be longer than shortest distance X1L defined by equation (13).

Since other arrangements and functions of the second embodiment are the same as those of the first embodiment, same elements are denoted by the same reference symbols, and descriptions thereof are omitted.

Third Embodiment

Figure 15A:
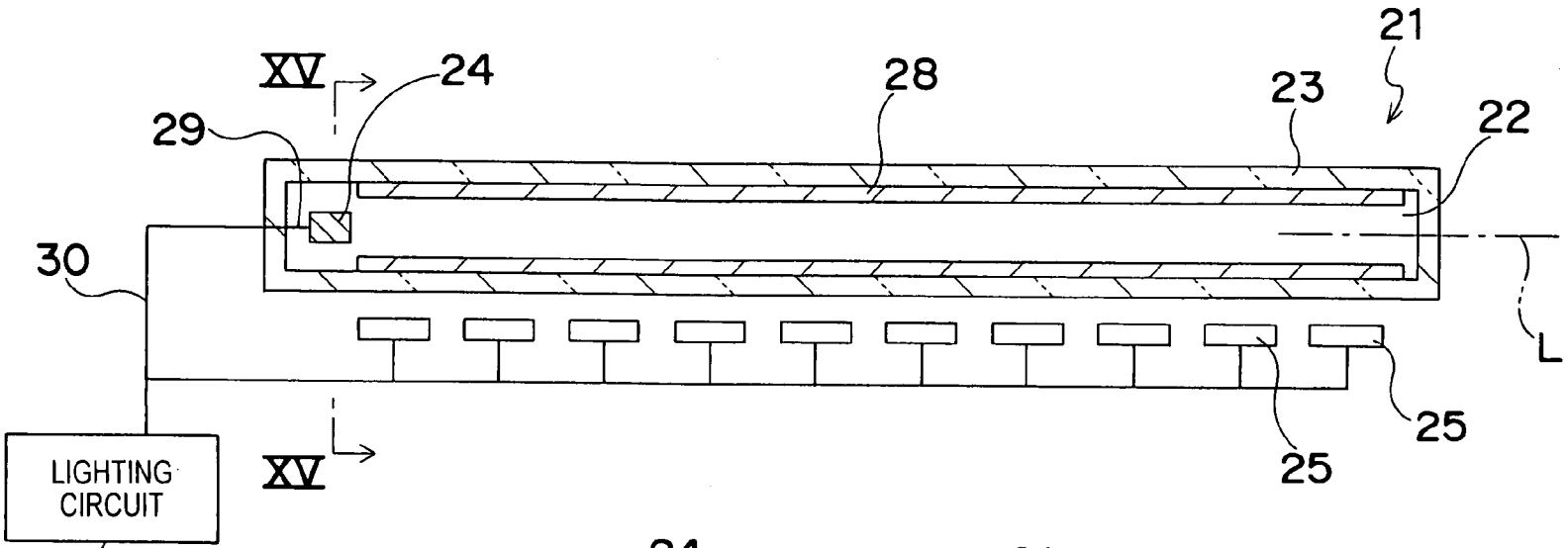
FIG. 15A is a cross-sectional view depicting a light source device according to a third embodiment of the present invention.
Figure 15B:
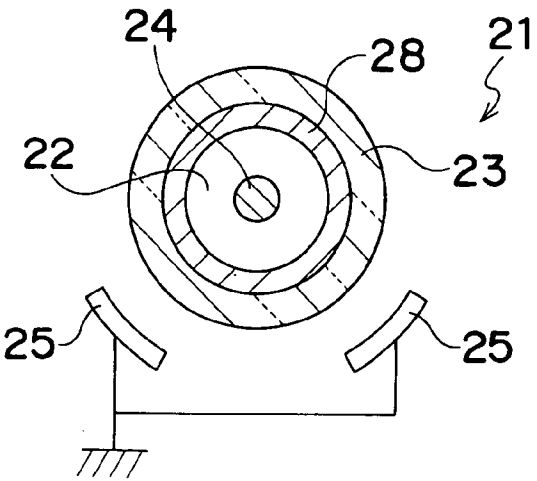
FIG. 15B is a cross-sectional view taken along line XV-XV in FIG. 15A.

In a third embodiment shown in FIGS. 15A and 15B, a plurality of external electrodes 25 are disposed at intervals along axis line L of bulb 23. Specifically there are two rows of a plurality of external electrodes 25 disposed at intervals along the direction of the axis line L. Each of external electrodes 25 is held by a holder member not illustrated, so as to be opposed to an outer surface of the bulb 23 with space 26 therebetween.

Since other arrangements and functions of the third embodiment are the same as those of the first embodiment, same elements are denoted by the same reference symbols, and descriptions thereof are omitted.

Fourth Embodiment

Figure 16A:
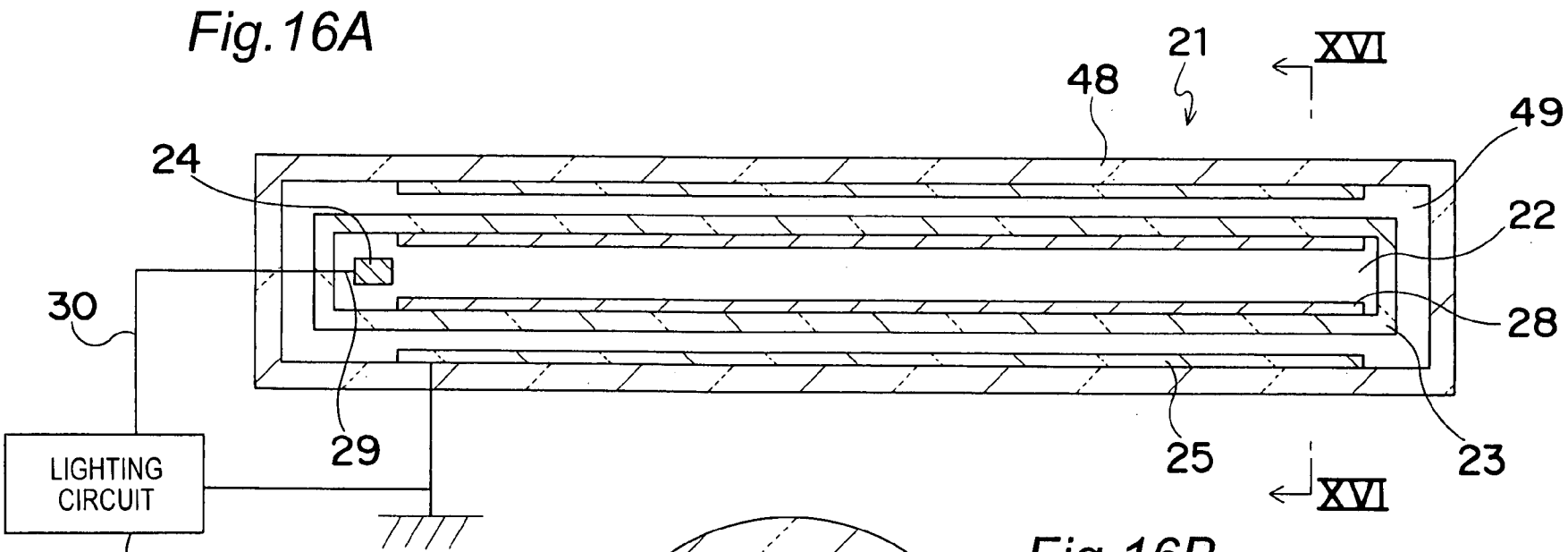
FIG. 16A is a cross-sectional view depicting a light source device according to a fourth embodiment of the present invention.
Figure 16B:
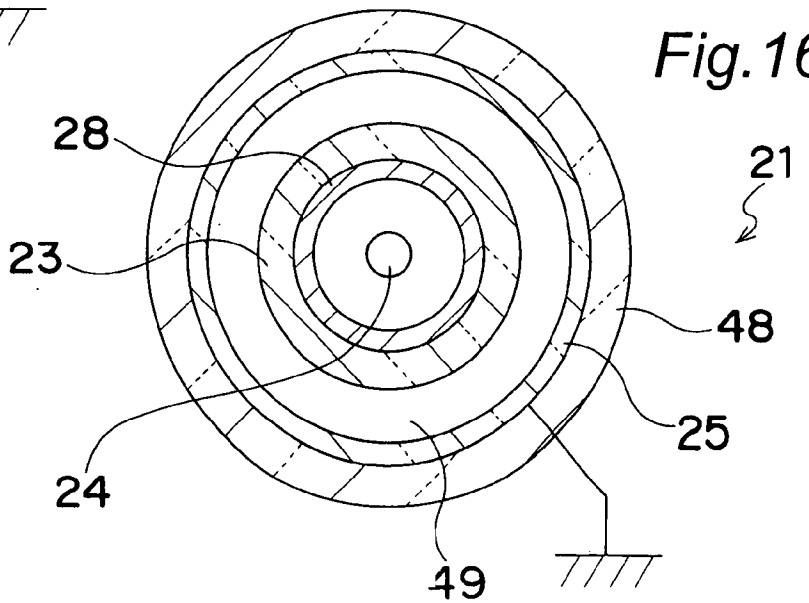
FIG. 16B is a cross-sectional view taken along line XVI-XVI in FIG. 16A.

In a fourth embodiment shown in FIGS. 16A and 16B, bulb 23 is sealed inside an air tight external container or vessel 48. Same as the bulb 23, the external vessel 48 is made of material with transparency such as glass (e.g. borosilicate glass, quartz glass, soda glass, lead glass) or organic matter (e.g. acrylic). A sealed space 49 is provided between an outer surface of the bulb 23 and an inner surface of the external vessel 48. Filled in the sealed space 49 is a rare gas such as argon, neon, krypton or xenon, and an inactive gas such as nitrogen. As long as dielectric breakdown does not occur, pressure in the sealed space 49 may be reduced. The bulb 23 and the external vessel 48 may be welded together at both ends thereof. Alternatively, a spacer made of insulation material such as silicon rubber may be interposed between the bulb 23 and the external vessel 48.

The external electrode 25 is formed on the inner surface of the external vessel 48. As clearly shown in FIG. 16B, external electrode 25 is formed so as to enclose an entire outer surface of the bulb 23. Thus, the external electrode 25 of the present embodiment is a transparent body such as a transparent conductive film (e.g. ITO) mainly composed of tin oxide, indium oxide and the like. The external electrode 25 made of the transparent conductive film allows light radiated from the bulb 23 to be emitted from the light source device 21 through the external vessel 48 without being reflected by the external electrode 25. Therefore, high luminous efficiency can be implemented.

Since other arrangements and functions of the fourth embodiment are the same as those of the first embodiment, same elements are denoted by same reference symbols, and descriptions thereof are omitted.

Figure 17A:
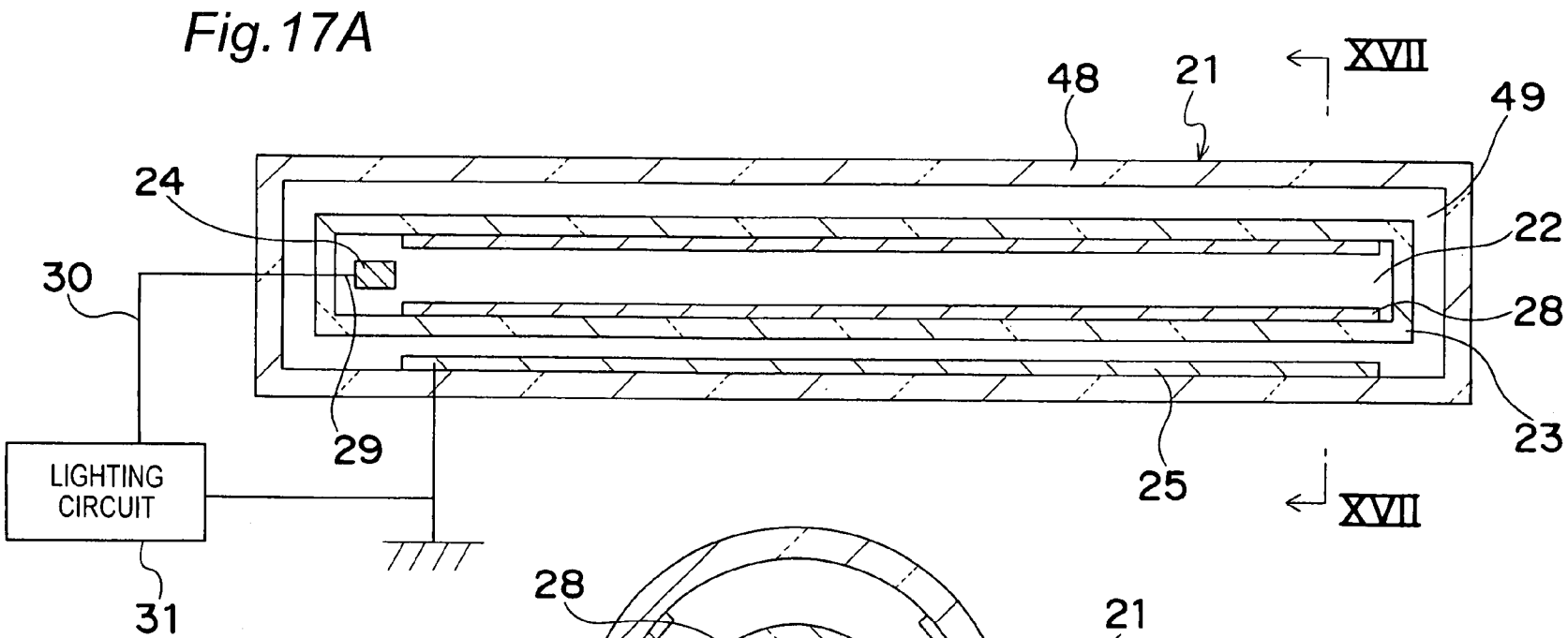
FIG. 17A is a cross-sectional view depicting a light source device according to a modification of the fourth embodiment.
Figure 17B:
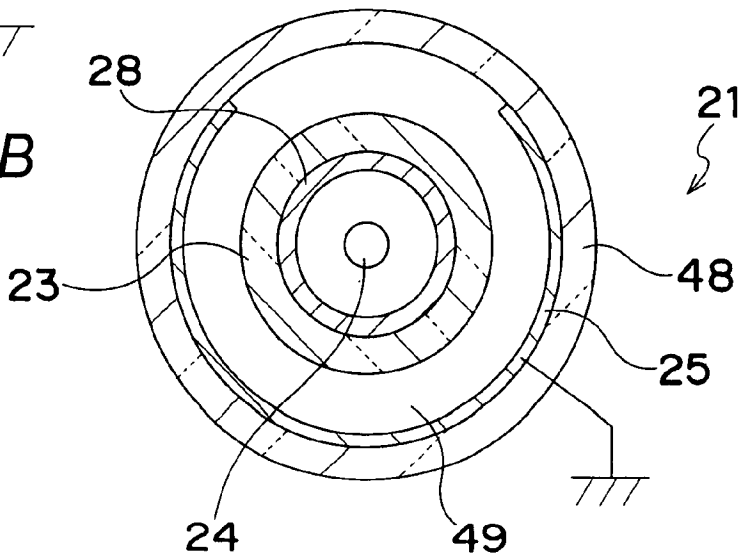
FIG. 17B is a cross-sectional view taken along line XVII-XVII in FIG. 16A.

In the light source device 21 according to a modification of the fourth embodiment shown in FIGS. 17A and 17B, the external electrode 25 formed on the inner surface of external vessel 48 is not formed around an entire outer surface of the bulb 23 but only around a part thereof. In other words, the external electrode 25 is formed on a part of the inner surface of external vessel 48. A shape of the external electrode 25 makes it possible to use commonly used metal material such as copper, aluminum and stainless steel, instead of a transparent conductive film, for the external electrode 25.

Fifth Embodiment

Figure 18B:
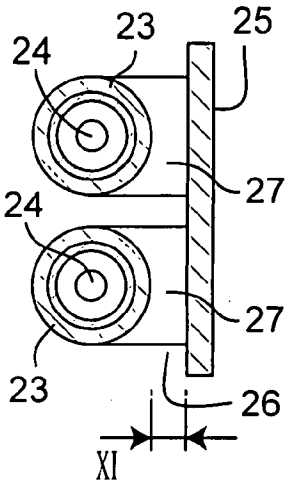
FIG. 18B is a cross-sectional view taken along line XVIII-XVIII in FIG. 18A.
Figure 18A:
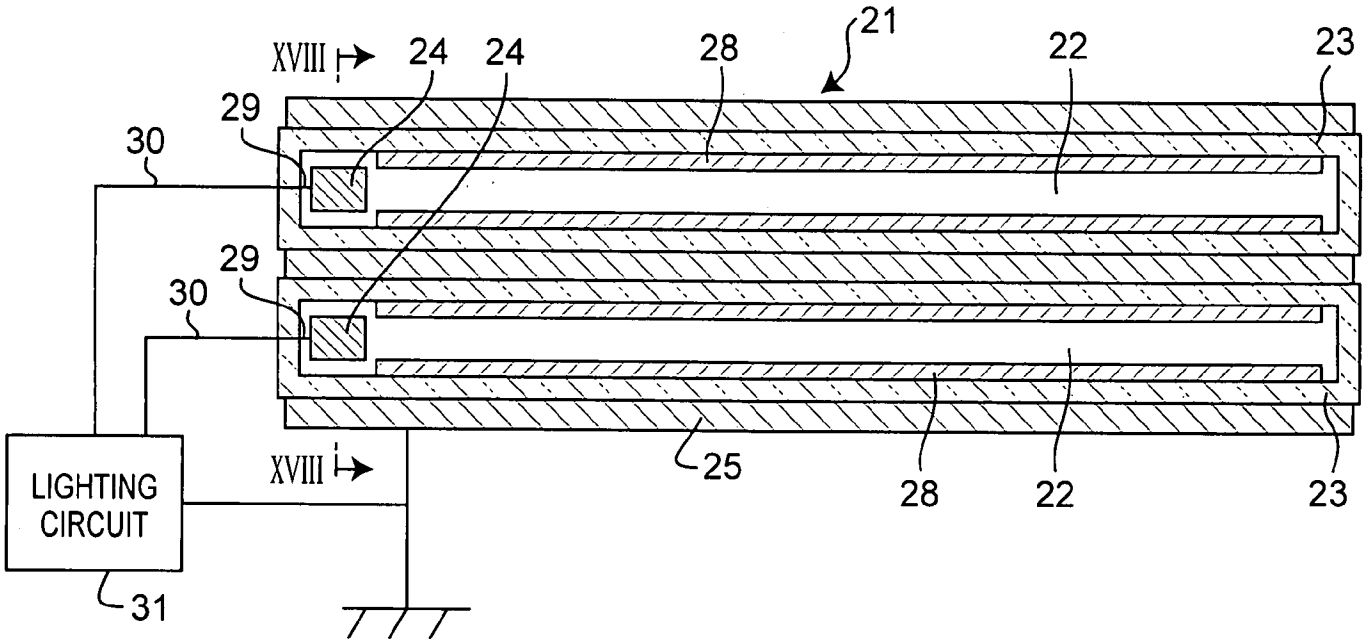
FIG. 18A is a cross-sectional view depicting a light source device according to a fifth embodiment of the present invention.

A light source device 21 according to a fifth embodiment of the present invention shown in FIGS. 18A and 18B has a pair of bulbs 23 disposed in parallel with each other. One internal electrode 24 is disposed inside each of the bulbs 23. Each of the internal electrodes 24 is electrically connected to a common lighting circuit 31 via lead wire 30. One common external electrode 25 is provided for the pair of bulbs 23. The external electrode 25 has a plate-like shape and is held by holder member 27 so as to be opposed each of the bulbs 23 with space 26 therebetween. The external electrode 25 is grounded.

The light source device 21 may be provided with at least three bulbs 23. The bulbs 23 need not be in parallel with each other, and the bulbs 23 can be freely arranged as long as each of the bulbs 23 is opposed to common external electrode 25 with the space 26 therebetween.

If the external electrode 2 is formed so as to closely contact the outer surface of the bulb 3 as shown in FIG. 31A, increase of a number of bulbs causes increase of a manufacturing defects generation rate concerning close contact of the external electrode 2 and the bulb 3, resulting in increasing of a manufacturing cost. However, in the present embodiment, since each bulb 23 is disposed away from the external electrode 25 via the space 26, a manufacturing defect generation rate is not increased by increase of the number of bulbs 23. In other words, as the number of bulbs 23 increases, the manufacturing cost is lower as compared to the conventional light source device shown in FIG. 31A.

Since other arrangements and functions of the fifth embodiment are the same as those of the first embodiment, same elements are denoted by same reference symbols, and descriptions thereof are omitted.

Sixth Embodiment

Figure 19:
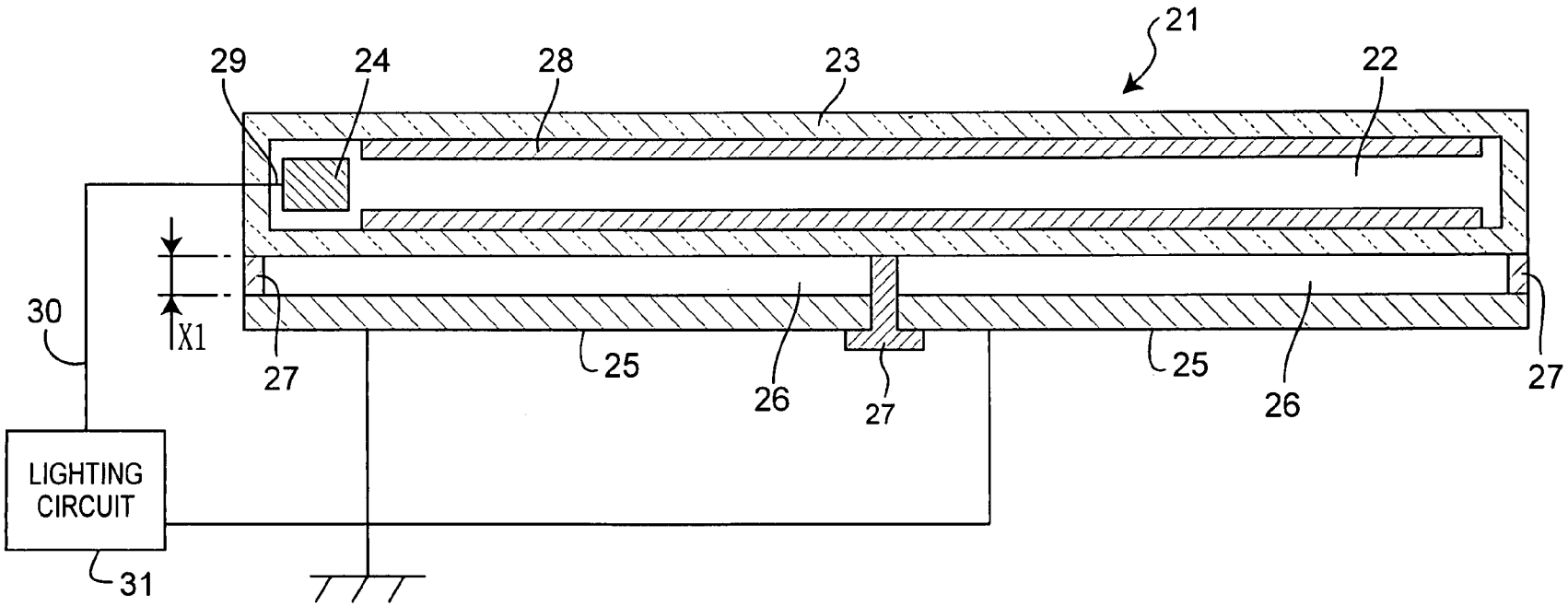
FIG. 19 is a cross-sectional view depicting a light source device according to a sixth embodiment of the present invention.

A light source device 21 according to a sixth embodiment of the present invention shown in FIG. 19 has a pair of strip type external electrodes 25 electrically isolated from each other, and each of the external electrodes 25 is grounded. One of the external electrodes 25 is connected to lighting circuit 31. Potentials of the external electrodes 25 may differ from each other.

Since other arrangements and functions of the sixth embodiment are the same as those of the first embodiment, same elements are denoted by same reference symbols, and descriptions thereof are omitted.

Seventh Embodiment

Figure 20:
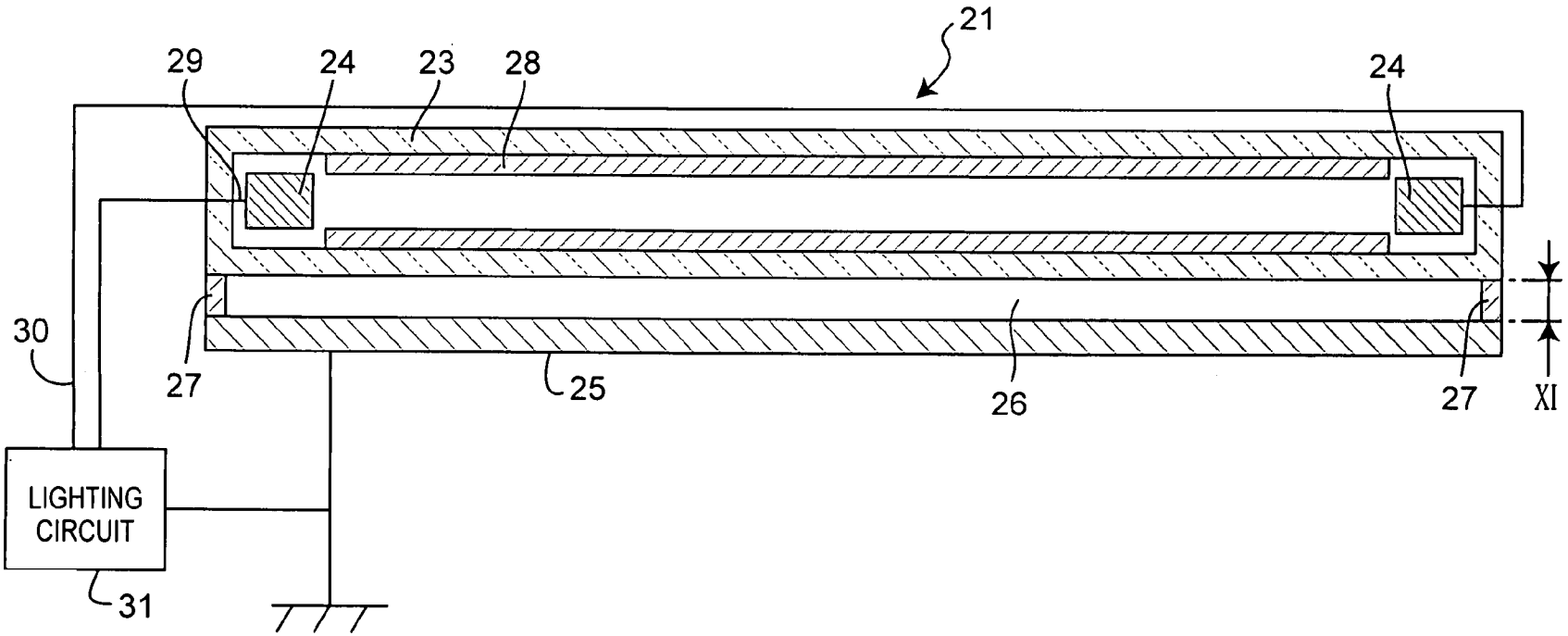
FIG. 20 is a cross-sectional view depicting a light source device according to a seventh embodiment of the present invention.

A light source device 21 according to a seventh embodiment of the present invention shown in FIG. 20 has a pair of internal electrodes 24 respectively disposed at ends of single bulb 23. The pair of the internal electrodes 24 is connected to lighting circuit 31 via lead wires 30, respectively.

An arrangement where plural internal electrodes 24 are disposed inside the single bulb 23 as the present embodiment stabilize discharge occurring inside the bulb 23, even if the bulb 23 has a long elongated shape.

Since other arrangements and functions of the seventh embodiment are the same as those of the first embodiment, same elements are denoted by same reference symbols, and descriptions thereof are omitted.

Eighth Embodiment

An eighth embodiment of the present invention shown in FIGS. 21 to 26 is an example where the present invention is applied to a liquid crystal display device. Specifically, liquid crystal display device 51 of the present embodiment comprises a liquid crystal panel 52 shown only in FIG. 22, and a back light device (lighting device) 53. The back light device 53 comprises light source devices 21A and 21B according to the present invention.

Figure 21:
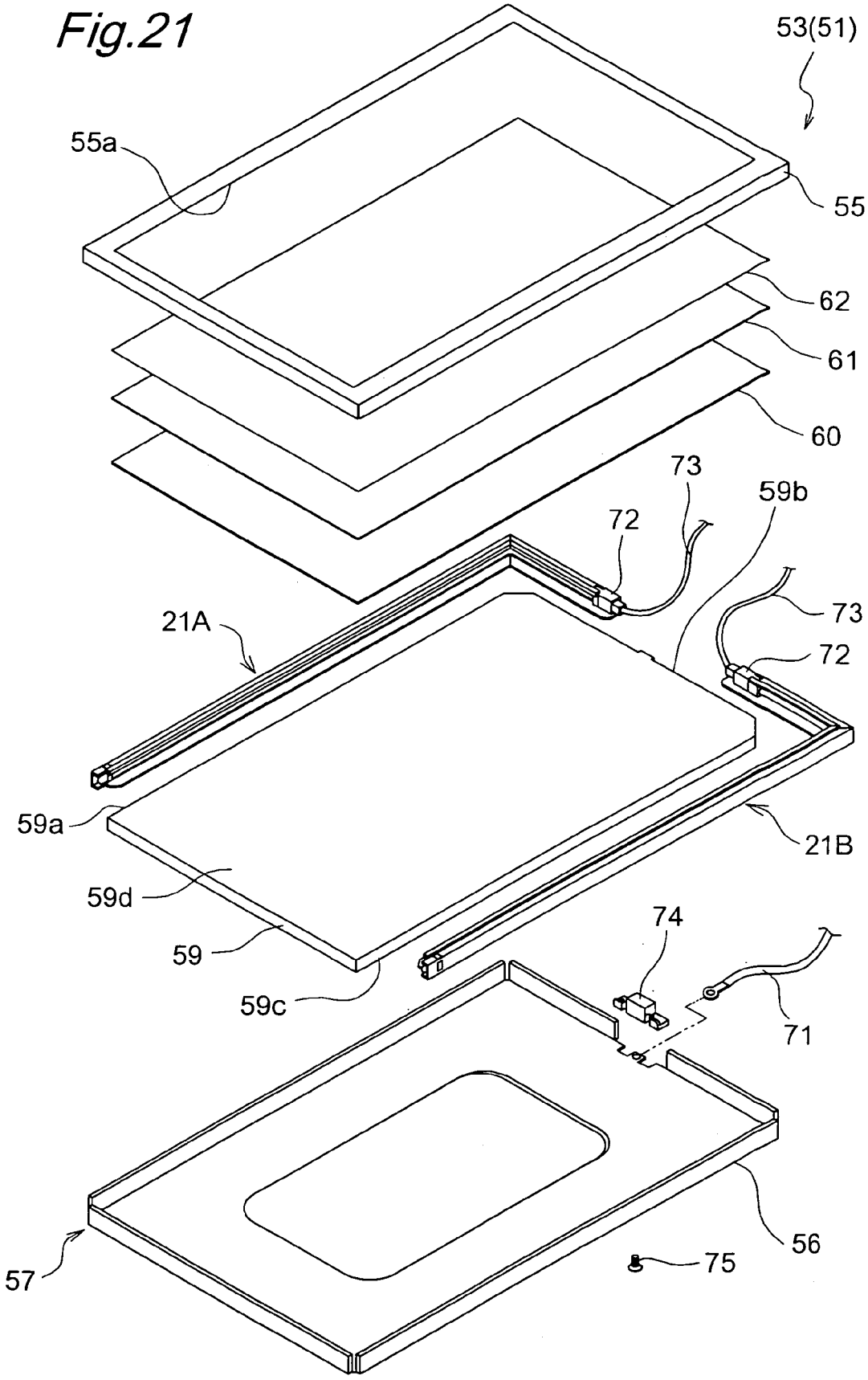
FIG. 21 is an exploded perspective view depicting a liquid crystal display device according to an eighth embodiment of the present invention.
Figure 22:
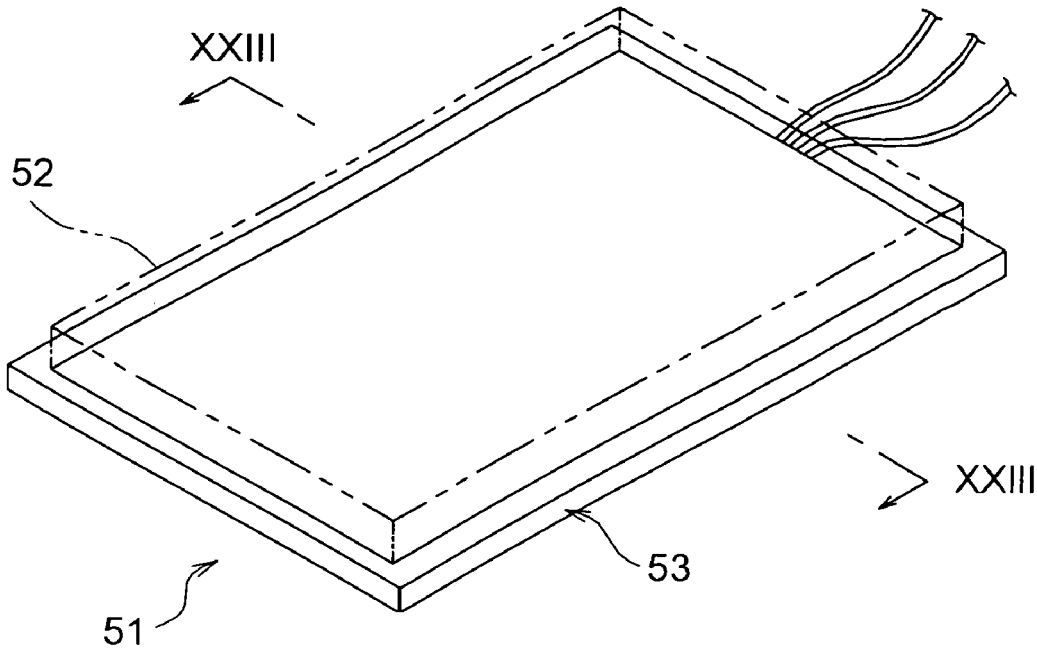
FIG. 22 is a perspective view depicting the liquid crystal display device according to the eighth embodiment of the present invention.
Figure 23:
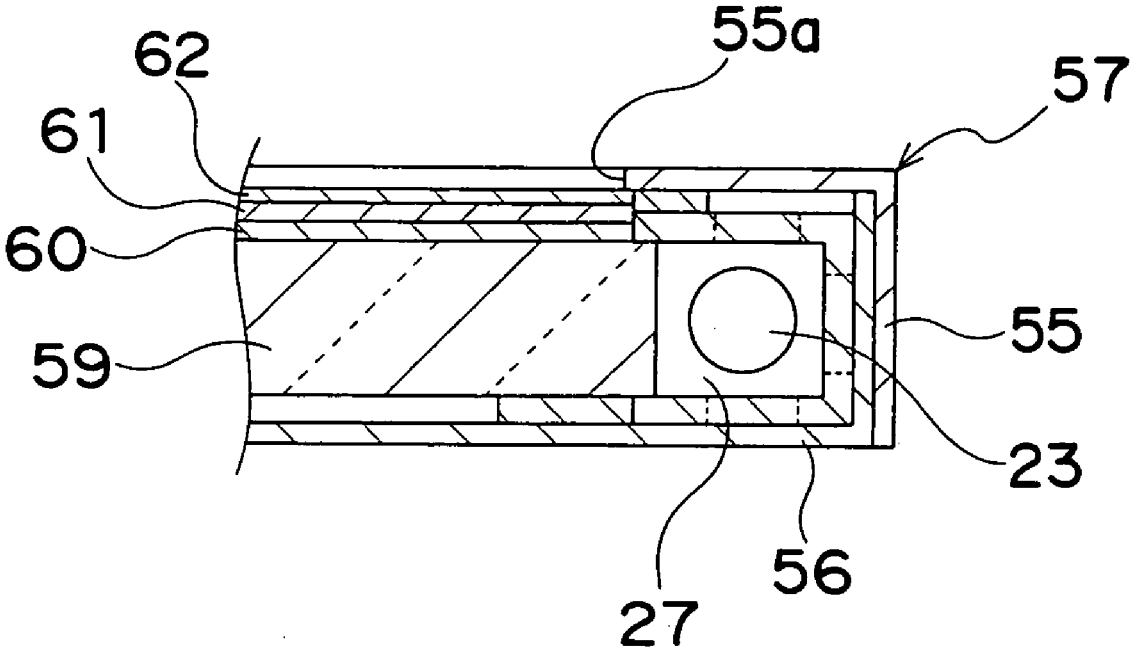
FIG. 23 is a partial cross-sectional view taken along line XXIII-XXIII in FIG. 22.
Figure 24:
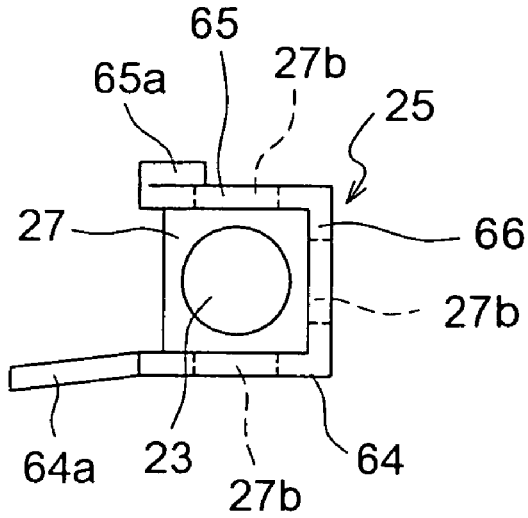
FIG. 24 is a right side view depicting a light source device.
Figure 25:
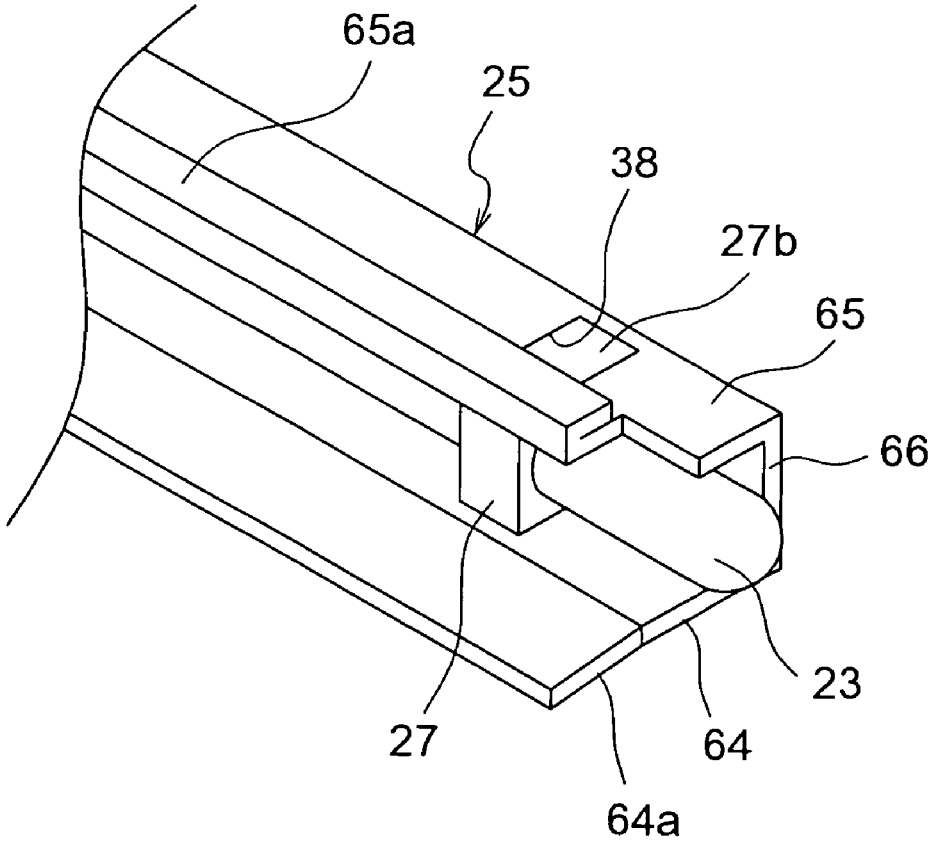
FIG. 25 is a partial enlarged perspective view depicting the light source device of FIG. 24.
Figure 26A:
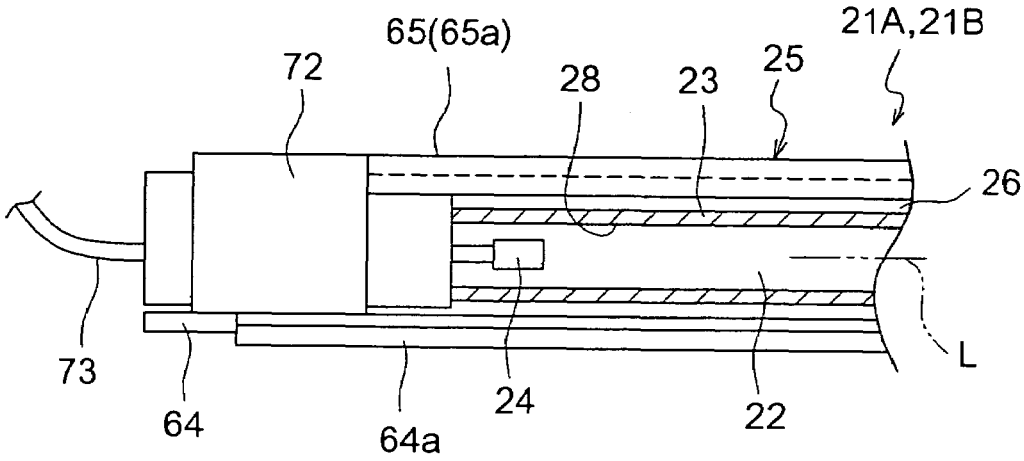
FIG. 26A is a partial enlarged view depicting the light source device of FIG. 24.
Figure 26B:
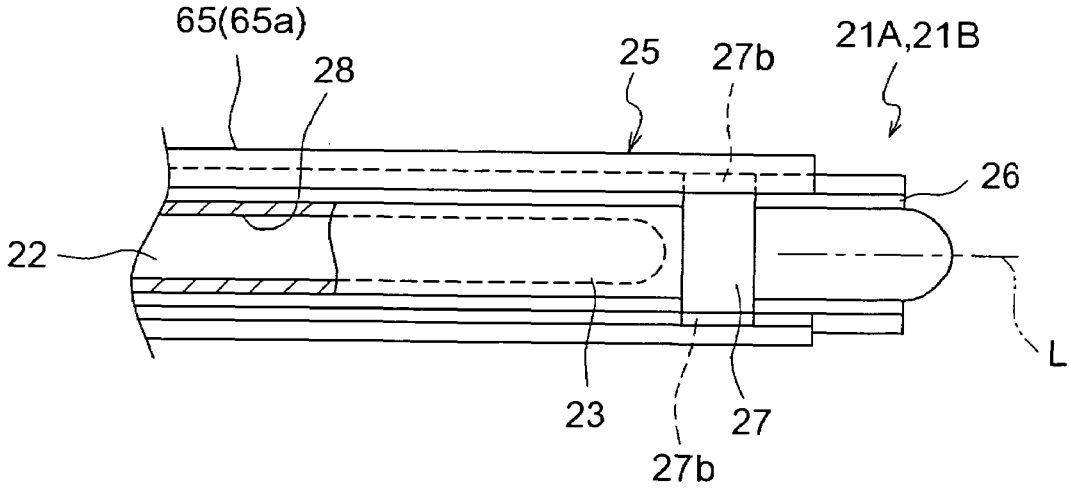
FIG. 26B is a partial enlarged view depicting the light source device of FIG. 24.

As shown in FIGS. 21 to 23, the back light device 53 comprises a case 57 including a top cover 55 and a back cover 56, which are made of metal. Accommodated in the back cover 56 so as to be layered are a light guide plate 59, light diffusing plate 60, lens plate 61 and polarizing plate 62. Each of the light source devices 21A and 21B has an L-like shape. One light source device 21A is disposed so as to be opposed one end face 59*a* of the light guide plate 59 as well as another end face 59*b* which continues from the end face 59*a*. The other light source device 21B is disposed so as to be opposed end face 59*c*, opposite to the end face 59*a*, and the end face 59*b*. Light emitted from the light source devices 21A and 21B enter the light guide plate 59 via the end faces 59*a* to 59*c*, and are emitted to a back face of the liquid crystal panel 52 from emission face 59*d* of the light guide plate 59 via the light diffusing plate 60, lens plate 61, polarizing plate 62 and opening 55*a* formed in the top cover 55.

As shown in FIGS. 21 and 23, each of the light source devices 21A and 21B comprises an L shaped bulb 23 inside which discharge medium containing a rare gas is sealed, an internal electrode 24 disposed inside the bulb 23, an external electrode 25 held by a holder member 27 and latter mentioned connectors 72 so as to be opposed the bulb 23 with space 26 therebetween. Unless otherwise specified, dimensions, material and shape of the bulb 23, internal electrode 24 and external electrode 25 of respective light source devices 21A and 21B are the same as those of the light source device 21 of the first embodiment. The discharge medium as well may be the same as that of the first embodiment.

The external electrode 25 has a U-like cross-sectional shape perpendicular to axis line L of the bulb 23, which comprises a back wall section 64 at a back cover side, a front wall section 65 at a top cover side, and a side section 66 which links the back wall section 64 and the front wall section 65. An extended section 64*a* is formed at an edge of the back wall section 64, and a fold back section 65*a* is formed at an edge of the front wall section 65. As most clearly shown in FIG. 23, each of the light source devices 21A and 21B can be supported at an appropriate position with respect to the light guide plate 59 by inserting the light guide plate 59 between the extended section 64*a* of the back wall section 64 and the fold back section 65*a* of the front wall section 65.

Structure and material of the holder member 27 are the same as those of the first embodiment (see FIG. 7). Specifically, the holder member 27 comprises support hole 27*a* though which the bulb 23 penetrates for being supported, and three engagement protrusions 27*b*. At one end of the external electrode 25, an engagement hole 38 is formed in each of the back wall section 64, front wall section 65 and side wall section 66, and the external electrode 25 is secured to the holder member 27 by the engagement protrusions 27*b* which fit into these engagement holes 38. A setting of a distance of the space 26 between the external electrode 25 and the holder member 27, when the external electrode is secured by the holder member 27, is the same as that of the first embodiment. For example, the distance of the space 26 is set to be longer than a shortest distance defined by equations (13) and (13)'.

The external electrode 25 is electrically connected to one end of a lead wire 71 via the back cover 56, and another end of the lead wire 71 is grounded. A proximal end side of rod-like conductive member 29 having the internal electrode 24 at a proximal end is electrically connected to a lead wire 73 inside the connector 72. The connector 72 is attached to the external electrode 25 at an opposite end from the holder member 27, and is made of insulation material. The lead wire 73 is electrically connected to a lighting circuit not illustrated. At one edge of the back cover 56, a fixation member 74 made of insulation material is secured by screws 75. Between the fixation member 74 and the back cover 56, a terminal at a tip end of the lead wire 71 for the external electrode 25 is fixed The fixation member 74 also has a function to guide the lead wire 73 at an internal electrode side out of the case 57. The fixation member 74 also has a function to position edges of each light source device 21A and 21B with respect to the case 57 by engaging the connector 72.

By disposing the external electrode 25 away from the bulb 23 with the space 26, the external electrode 25 of the back light device 53 has two functions in addition to primary functions. First, the external electrode 25 functions as a reflection member for directing light radiated from the bulb 23 to the end faces 59*a* to 59*c* of the light guide plate 59. In other words, it is unnecessary to dispose a dedicated reflection member in addition to the external electrode 25, resulting in that a number of elements is decreased. Secondly, the external electrode 25 has a function to position the light source devices 21A and 21B with respect to the light guide plate 59 as mentioned above.

Since other arrangements and functions of the eighth embodiment are the same as those of the first embodiment, same elements are denoted by same reference symbols, and descriptions thereof are omitted.

Ninth Embodiment

Figure 27B:
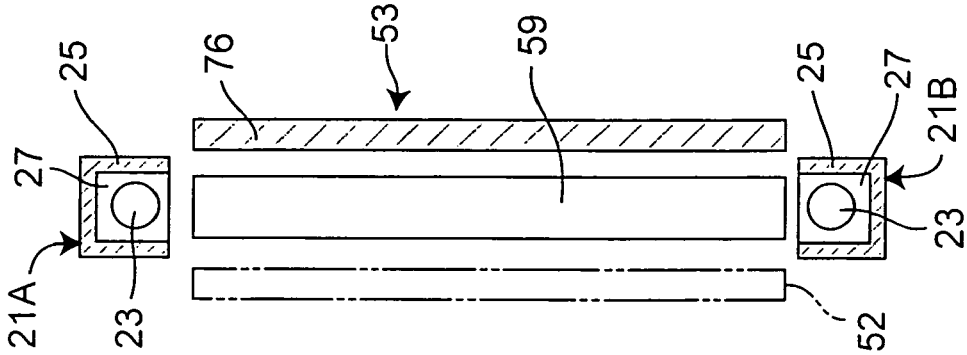
FIG. 27B is a cross-sectional view taken along line XXVII-XXVII in FIG. 27A.
Figure 27A:
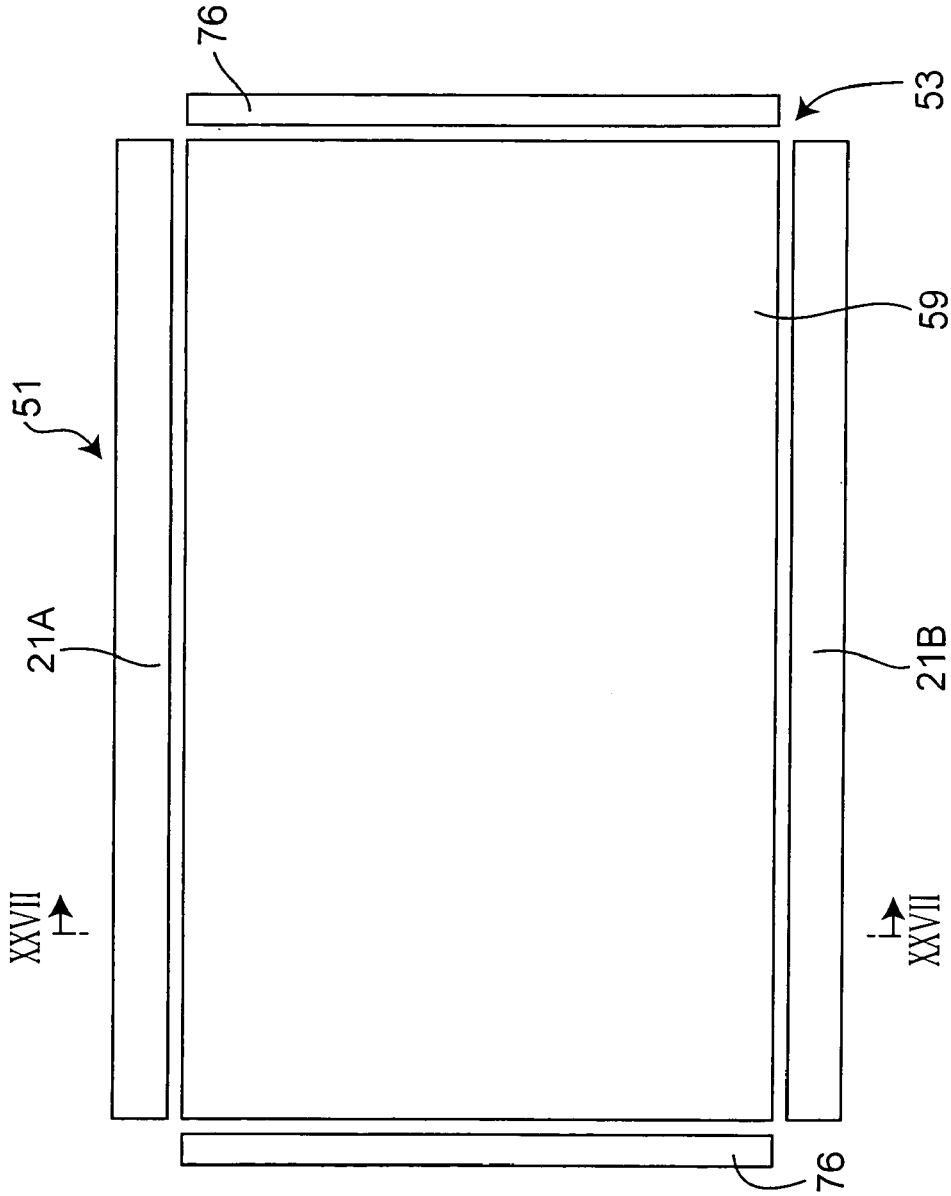
FIG. 27A is a plan view depicting a liquid crystal display device according to a ninth embodiment of the present invention.

A back light device 53 of a liquid crystal display device 51 according to a ninth embodiment shown in FIGS. 27A and 27B comprises a pair of light source devices 21A and 21B respectively having a straight pipe-like shape. Reflection sheets 76 for reflecting light are disposed on two end faces, of six end faces of light guide plate 59, to which the light source devices 21A and 21B are not disposed, as well as a bottom face of the light guide plate 59. Elements for controlling light distribution such as a light diffusing plate, lens plate and polarizing plate may be disposed on an emission face of the light guide plate 59, although these are not illustrated in FIGS. 27A and 27B.

Since other arrangements and functions of the ninth embodiment are the same as those of the first embodiment, same elements are denoted by same reference symbols, and descriptions thereof are omitted.

Tenth Embodiment

Figure 28B:
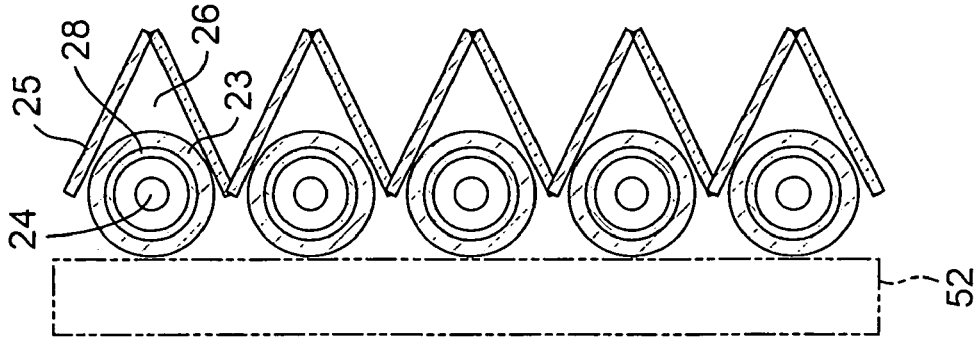
FIG. 28B is a cross-sectional view taken along line XXV-XXV in FIG. 28A.
Figure 28A:
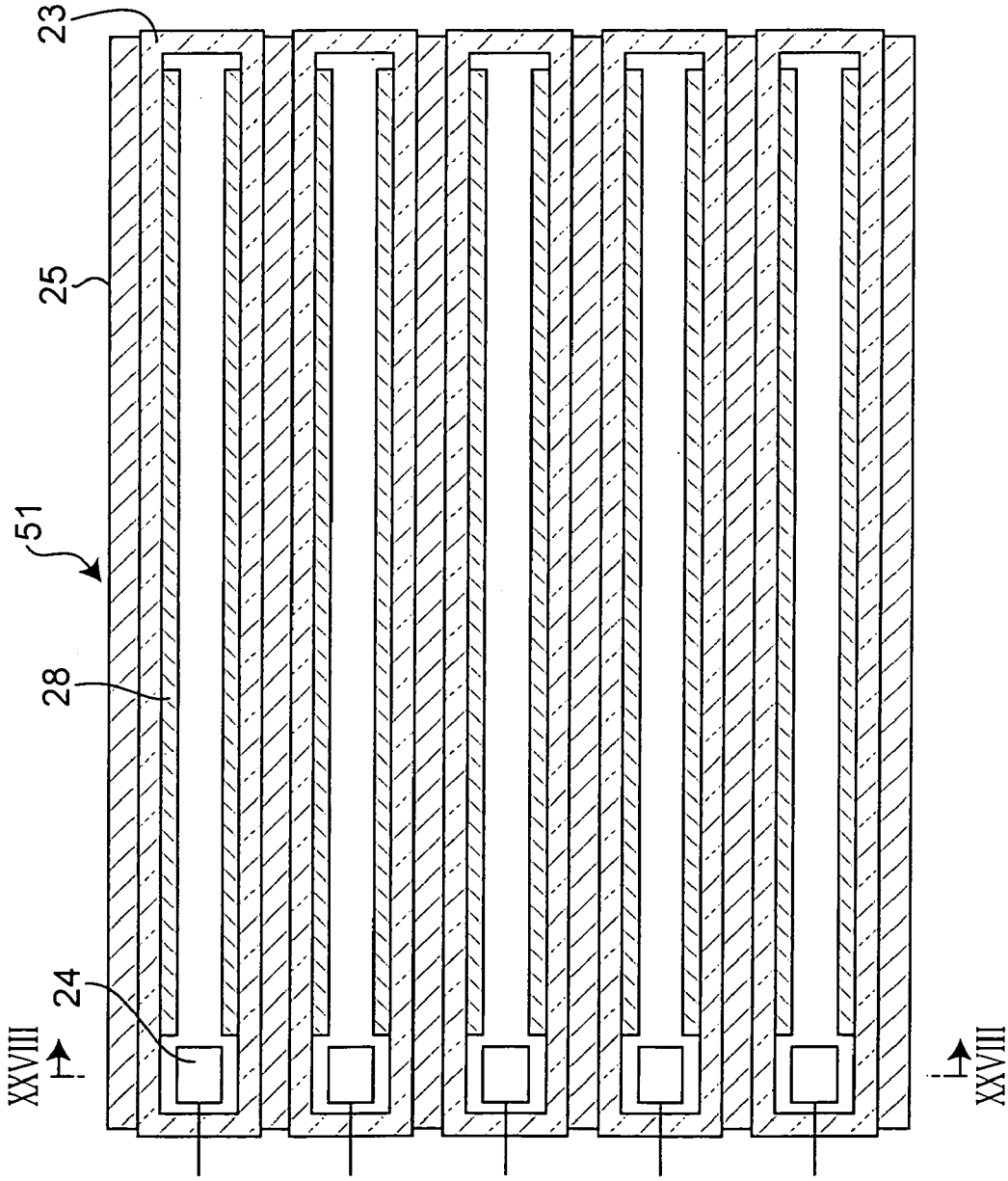
FIG. 28A is a plan view depicting a lighting device according to a tenth embodiment of the present invention.

A liquid crystal display device 51 according to a tenth embodiment of the present invention shown in FIGS. 28A and 28B comprises a liquid crystal panel 52 and back light device 53 which function as a surface illuminant. The back light device 53 has a plurality of straight pipe-like bulbs 23 disposed in parallel with each other. Internal electrode 24 is disposed respectively inside each of the bulbs 23. One external electrode 25 is provided commonly for the bulbs 23. The external electrode 25 is opposed to each of the bulbs 23 with space 26 therebetween. Elements for controlling light distribution such as a light guide plate, light diffusing plate, lens plate and polarizing plate may be disposed between bulbs 23 and the liquid crystal panel 52, although those are not illustrated in FIGS. 28A and 28B.

Since other arrangements and functions of the tenth embodiment are the same as those of the first embodiment, same elements are denoted by same reference symbols, and descriptions thereof are omitted.

Eleventh Embodiment

Figure 29:
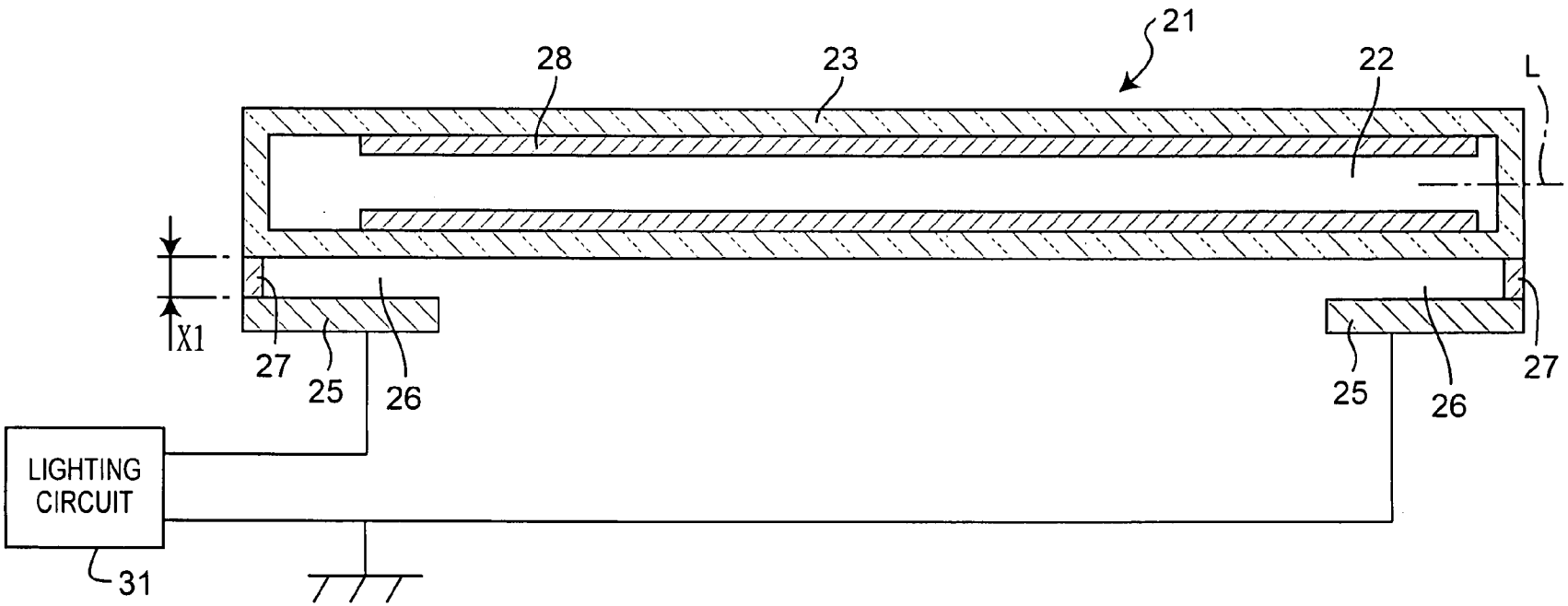
FIG. 29 is a cross-sectional view depicting a light source device according to an eleventh embodiment of the present invention.

In the first to tenth embodiments, the electrode connected to the lighting circuit is the internal electrode 24, with the external electrode 25 being grounded. Whereas in an eleventh embodiment shown in FIG. 29, an electrode connected to a lighting circuit side is external electrode 125.

Specifically light source device 21 according to the present embodiment comprises an external electrode 125 opposed to an external surface of bulb 23 at around one end of the bulb 23 via space 26, and electrically connected to lighting circuit 31, and an external electrode 25 opposed to the outer surface of the bulb 23 at around the other end of the bulb 23 with the space 26 and being grounded. These external electrodes 25 and 125 are opposed to each other in an axis line L direction of the bulb 23 via a space. Further, these external electrodes 25 and 125 are held respectively to the bulb 23 by a holder member 27. Distance X1 between each of the external electrodes 25 and 125 and the outer surface of the bulb 23 is set to be longer than shortest distance X1L defined by equation (13), resulting in that dielectric breakdown between the external electrodes 25, 125 and the bulb 23 is prevented.

In case that the electrodes for connection both to the lighting circuit 31 and ground are the external electrodes 25 and 125 as with the present embodiment, an arrangement where both of the external electrodes 25 and 125 are disposed relative to the outer surface of the bulb 23 via a space is particularly effective. A reason for this effectiveness will be described hereinbelow.

Because a starting voltage for dielectric barrier discharge between the external electrodes 25 and 125 is higher than that of a case when one is an internal electrode and the other is an external electrode, dielectric breakdown easily occurs when the dielectric barrier discharge is started by the external electrodes 25 and 125. Therefore, prevention of dielectric breakdown by providing the space 26 between the bulb 23 and the external electrodes 25 and 125 is particularly effective for the arrangement of the present embodiment.

Since the other arrangements and functions of the eleventh embodiment are the same as those of the first embodiment, same elements are denoted by same reference symbols, and descriptions thereof are omitted.

Figure 30:
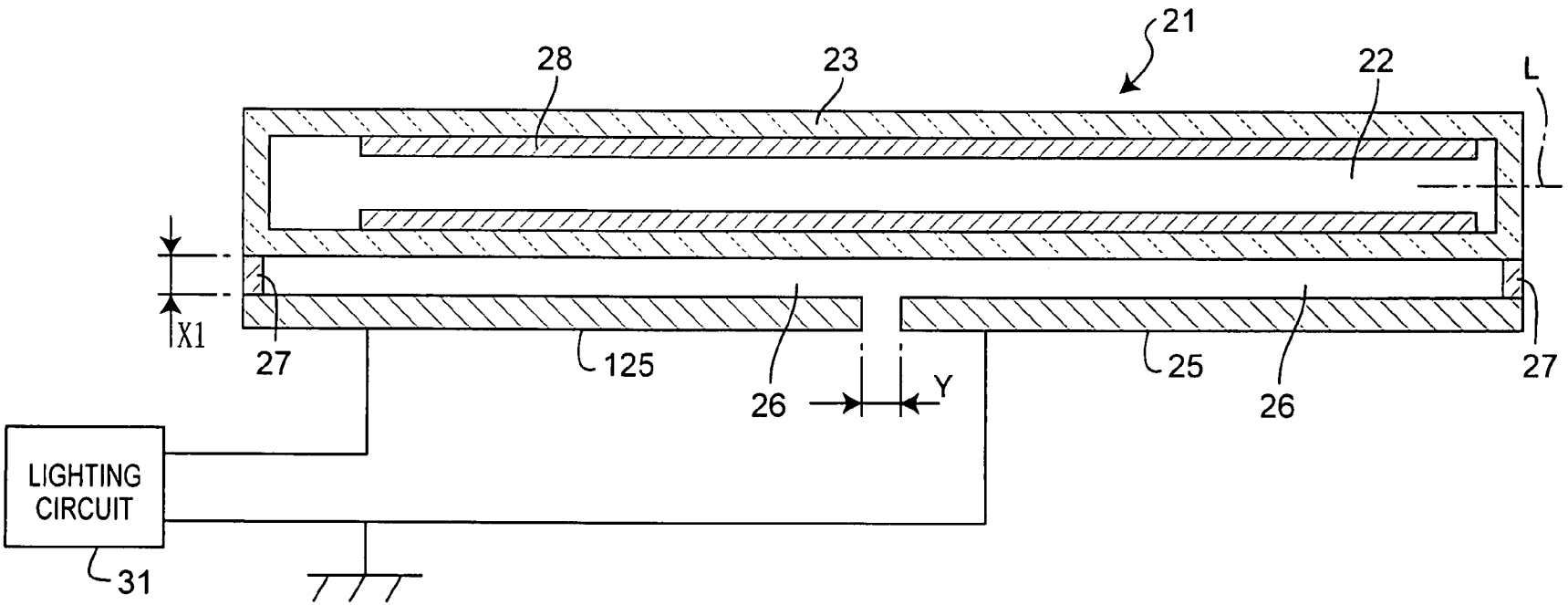
FIG. 30 is a cross-sectional view depicting a light source device according to a modification of the eleventh embodiment of the present invention.

FIG. 30 shows a modification of the eleventh embodiment. In this modification, distance Y between the external electrodes 25 and 125 in the axis line L direction is set to be much shorter than that of the tenth embodiment. In other words, the two external electrodes 25 and 125 are disposed as closely as a shortest distance. By disposing the external electrode 125 connected to the lighting circuit 31 and the external electrode 25 connected to the ground as closely as the shortest distance, a starting voltage of the dielectric barrier discharge is lowered, resulting in that occurrence of dielectric barrier discharge becomes easy.

The light source device of the present invention can be used not only for the back light device of the liquid crystal display device as with the tenth embodiment, but also for various light sources such as a light source for general-purpose illuminations, an excimer lamp as a UV light source, and a bactericidal lamp.

Although the present invention has been fully described in conjunction with preferred embodiments thereof with reference to the accompanying drawings, various changes and modifications are possible for those skilled in the art. Therefore, such changes and modifications should be construed as included in the present invention unless they depart from the intention and scope of the invention as defined by the appended claims.

What is claimed is:

1. A light source device, comprising:

at least one bulb;

a discharge medium, containing a rare gas, sealed inside said at least one bulb;

a first electrode inside said at least one bulb;

a second electrode outside said at least one bulb; and a holder for holding said second electrode such that said second electrode opposes said at least one bulb across a space so as to be spaced from said at least one bulb by a predetermined distance, wherein the predetermined distance is greater than a shortest distance defined by the following equation, $$X1L = \frac{V}{EO} - \frac{\varepsilon 1}{\varepsilon 2} \times X2,$$

with

X1L being the shortest distance,

E0 being a dielectric breakdown field of atmospheric gas,

V being an input voltage,

∈1 being a dielectric constant of the space,

∈2 being a dielectric constant of a wall of said at least one bulb, and

X2 being a thickness of the wall of said at least one bulb.

2. The light source device according to claim 1, further comprising:

a lighting circuit to which said first electrode is electrically connected, wherein said second electrode is grounded.

3. The light source device according to claim 1, wherein air is filled in the space, and the predetermined distance by which said second electrode is spaced from said at least one bulb is within a range between 0.1 mm and 2.0 mm.

4. The light source device according to claim 1, wherein said rare gas contained in said discharge medium is at least one gas selected from the group consisting of xenon, krypton, argon and helium.

5. The light source device according to claim 1, wherein said discharge medium contains mercury.

6. The light source device according to claim 1, wherein said at least one bulb has a shape extending along an axial line thereof, and a cross-section of said second electrode perpendicular to the axial line of said at least one bulb has a shape surrounding said at least one bulb except for an open section.

7. The light source device according to claim 6, further comprising:

a reflection layer on a surface of said second electrode such that said reflection layer opposes said at least one bulb.

8. The light source device according to claim 6, wherein the cross-section of said at least one bulb perpendicular to the axial line has a circular shape, and the cross-section of said second electrode perpendicular to the axial line has a shape other than a circle concentric with respect to the cross-section of said at least one bulb.

9. The light source device according to claim 6, wherein the cross-section of said second electrode perpendicular to the axial line of said at least one bulb comprises two first flat walls opposed to each other with said at least one bulb therebetween, and a second flat wall which links said two first flat walls and is opposed to the open section with said at least one bulb between said second flat wall and the open section.

10. The light source device according to claim 1, wherein said at least one bulb has a shape extending along an axial line of said at least one bulb, and said second electrode has a strip-like shape extending along the axial line of said at least one bulb.

11. The light source device according to claim 1, wherein said at least one bulb has a shape extending along an axial line of said at least one bulb, and further comprising:

another second electrode outside said at least one bulb, with said second electrode and said another second electrode being positioned at intervals along the axial line of said at least one bulb.

12. The light source device according to claim 1, further comprising:

a vessel in which said at least one bulb is enclosed, with said second electrode being on an inner surface of said vessel such that said vessel functions as said holder.

13. The light source device according to claim 1, wherein said at least one bulb comprises plural bulbs, with a corresponding said first electrode being inside each of said plural bulbs, and with said second electrode being common to said plural bulbs.

14. A lighting device, comprising:

the light source device according to claim 1; and a light guide plate for guiding light emitted by said light source device from a light incident surface to a light emitting surface so as to emit the light from the light emitting surface.

15. A liquid crystal display device, comprising:

the lighting device according to claim 14; and a liquid crystal panel opposed to the light emitting surface of said light guide plate.

* * * * *